US009459584B2

(12) United States Patent
Kobayashi et al.

(10) Patent No.: US 9,459,584 B2
(45) Date of Patent: Oct. 4, 2016

(54) IMAGE FORMING APPARATUS

(71) Applicant: CANON KABUSHIKI KAISHA, Tokyo (JP)

(72) Inventors: Shinsuke Kobayashi, Yokohama (JP); Ken Nakagawa, Yokohama (JP); Akihiko Uchiyama, Mishima (JP); Tomonori Shida, Mishima (JP); Kazuhiro Funatani, Mishima (JP); Hiroshi Kita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/475,259

(22) Filed: Sep. 2, 2014

(65) Prior Publication Data

US 2015/0063834 A1 Mar. 5, 2015

(30) Foreign Application Priority Data

Sep. 3, 2013 (JP) ..... 2013-181995
Jul. 30, 2014 (JP) ..... 2014-154993

(51) Int. Cl.
*G03G 21/00* (2006.01)
*G03G 21/18* (2006.01)
*G03G 15/043* (2006.01)

(52) U.S. Cl.
CPC ..... *G03G 21/1817* (2013.01); *G03G 15/043* (2013.01); *G03G 21/1821* (2013.01); *G03G 21/1828* (2013.01); *G03G 21/1825* (2013.01); *G03G 2221/1684* (2013.01); *G03G 2221/1869* (2013.01)

(58) Field of Classification Search
CPC ..... G03G 21/18; G03G 21/1821; G03G 21/1817; G03G 21/1828; G03G 21/1853; G03G 21/1803; G03G 21/1814; G03G 21/1896
USPC ..... 399/12, 13, 110, 111, 113
See application file for complete search history.

(56) References Cited

U.S. PATENT DOCUMENTS

2007/0177899 A1* 8/2007 Kawamura ..... G03G 15/0121 399/223
2008/0286001 A1* 11/2008 Matsumoto et al. ..... 399/112
2011/0311272 A1* 12/2011 Nittani ..... G03G 21/1821 399/111
2012/0020699 A1* 1/2012 Kamimura ..... 399/111
2012/0183323 A1* 7/2012 Nakano ..... G03G 15/0194 399/110

FOREIGN PATENT DOCUMENTS

JP 2007-213024 A 8/2007

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

An image forming apparatus includes a mounting portion to and from which a process cartridge including a photosensitive member and a developing roller is attachable and detachable, a separation mechanism that takes a first position to separate the developing roller from the photosensitive member and a second position to bring the developing roller into contact with the photosensitive member, an allowance mechanism that allows the process cartridge with the developing roller kept in contact with the photosensitive member to be mounted on the mounting portion when the separation mechanism is in the first position, an exposure device, and a control unit, wherein, when the developing roller and the photosensitive member are in contact with each other when the separation mechanism is in the first position, the control unit performs an exposure operation while keeping the separation mechanism in the first position during an initial operation of the image forming apparatus.

46 Claims, 25 Drawing Sheets

IMAGE FORMING APPARATUS

BACKGROUND OF THE INVENTION

1. Field of the Invention

The present invention relates to an image forming apparatus using an electrophotographic method, such as a laser printer, a copying machine, and a facsimile machine.

2. Description of the Related Art

In some conventional image forming apparatuses of the electrophotographic method, process units, such as a photosensitive drum and a developing unit, in each image forming unit are integrated into a process cartridge, and such process cartridges are arranged in line to be attachable to and detachable from the image forming apparatus. This arrangement enables the user, without the aid of a service engineer, to replace process cartridges, for example, in the event of run-out of developer as well as to replace other consumables, such as photosensitive drums, at the same time, thus enhancing maintenance performance.

As a developing method employed in process cartridges for use in such image forming apparatuses, a contact developing method is generally widely adopted in which development is performed with a developing roller, serving as a developing unit, kept in contact with a photosensitive drum.

In image forming apparatuses using the contact developing method, if a developing roller and a photosensitive drum are not used for a long time with them kept in contact with each other, an elastic layer of the developing roller may be deformed, or developer borne on the developing roller may unnecessarily adhere to the photosensitive drum, thus causing image defects.

To address this issue, Japanese Patent Application Laid-Open No. 2007-213024 discusses an image forming apparatus equipped with a separation mechanism that acts on a process cartridge, when image formation is not performed, to separate a developing roller from a photosensitive drum. The separation mechanism for the developing roller arranged in the image forming apparatus takes three contact/separation states in which, in each image forming unit, a developing roller is in contact with or separated from a photosensitive drum. More specifically, the three contact/separation states include a "full-color image forming state" in which, in all of the image forming units, the developing roller is in contact with the photosensitive drum, a "mono-color image forming state" in which, in only the black image forming unit, the developing roller is in contact with the photosensitive drum, and a "standby state" in which, in all of the image forming units, the developing roller is separated from the photosensitive drum.

The image forming apparatus discussed in Japanese Patent Application Laid-Open No. 2007-213024 changes over between a contact state and a separation state of the developing roller and the photosensitive drum according to an operation of the separation mechanism of the image forming apparatus.

The state of the separation mechanism changes in order, such as "standby state"→"full-color image forming state"→"mono-color image forming state"→"standby state"→ . . . .

The separation mechanism, when in the standby state, separates the developing roller from the photosensitive drum in all of the image forming units. Thus, the standby state is a state taken when the image forming apparatus is on standby without performing image formation. Also, the separation mechanism, when in the full-color image forming state, cancels the separation state and brings the developing roller into contact with the photosensitive drum in all of the image forming units. Thus, the full-color image forming state is a state taken when the image forming apparatus forms a full-color image. Furthermore, the separation mechanism, when in the mono-color image forming state, cancels the separation state and brings the developing roller into contact with the photosensitive drum in only the image forming unit that forms a black image. On the other hand, in the other forming units (yellow, cyan, and magenta image forming units), the separation mechanism, when in the mono-color image forming state, separates the developing roller from the photosensitive drum. Thus, the mono-color image forming state is a state taken when the image forming apparatus forms a mono-color (black and white) image.

Then, after the completion of a normal image forming operation, the separation mechanism separates all of the developing rollers from the respective photosensitive drums to enter the "standby state" and, then, the image forming apparatus terminates the entire operation.

In this instance, due to the attachment or detachment of a process cartridge by the user, the power on or off of the image forming apparatus, or the plugging or unplugging of the image forming apparatus, the state of the separation mechanism may be different from the actual contact/separation state of the photosensitive drum and the developing roller.

For example, a case can be considered where, when the separation mechanism of the image forming apparatus is in the "standby state", a process cartridge is taken out of the main body of the image forming apparatus and the process cartridge is then inserted into the main body with the developing roller and the photosensitive drum kept in contact with each other. In such a case, the state of the separation mechanism is different from the actual contact/separation state of the photosensitive drum and the developing roller. In other words, while the state of the separation mechanism is in the standby state (originally, a state to separate the developing roller from the photosensitive drum), the developing roller is actually in contact with the photosensitive drum.

If the state of the separation mechanism does not coincide with the actual contact/separation state of the photosensitive drum and the developing roller, the image forming apparatus becomes unable to recognize the actual contact/separation state of the photosensitive drum and the developing roller (the actual contact/separation state of the photosensitive drum and the developing roller becomes unrecognizable). In such a situation, the image forming apparatus may not be able to correctly control the contact/separation state of the photosensitive drum and the developing roller.

Accordingly, in a case where the actual contact/separation state of the photosensitive drum and the developing roller becomes unrecognizable, the image forming apparatus is required to conform the state of the separation mechanism to the actual contact/separation state of the photosensitive drum and the developing roller before performing an image forming operation.

Therefore, the image forming apparatus performs, in an initial operation (a preparation operation prior to an image forming operation), control to cause the separation mechanism to operate to shift from the "standby state" to the "full-color image forming state".

Thus, before the initial operation (for example, immediate after the image forming apparatus is powered on), there is a possibility that the state of the separation mechanism is different from the actual contact/separation state of the photosensitive drum and the developing roller.

Therefore, if the separation mechanism is shifted from the standby state to the full-color image forming state due to the initial operation, the developing roller is brought into contact with the photosensitive drum after the initial operation in all of the image forming units irrespective of the contact/separation state taken before the initial operation.

Thus, if the separation mechanism is shifted, in the initial operation, to the "full-color image forming state" to bring all of the developing rollers into contact with the respective photosensitive drums, the state of the separation mechanism coincides with the actual contact/separation state of the photosensitive drum and the developing roller. Once the state of the separation mechanism coincides with the actual contact/separation state of the photosensitive drum and the developing roller, even when the separation mechanism is caused to operate after the initial operation, the state of the separation mechanism constantly becomes coincident with the actual contact/separation state of the photosensitive drum and the developing roller. The image forming apparatus is thus able to surely control the contact/separation state.

However, in a case where the above-described control is performed, the time required for the initial operation lengthens by a time required for the separation mechanism to operate in the initial operation, so that the time at which the image forming operation starts would become late.

For example, an initial operation after the user has performed detachment and attachment of process cartridges when the separation mechanism of the image forming apparatus is in the "standby state" is described. Here, the initial operation is an operation initially performed to check whether any residual paper remains inside the image forming apparatus or the image forming apparatus functions well after the image forming apparatus is powered off and on or after the paper jam is removed.

FIG. 25 is a timing chart illustrating the initial operation performed in the above-mentioned case. The initial operation illustrated in FIG. 25 is a calibration operation. The calibration operation is an operation to adjust the tint or color misregistration of an image output from the image forming apparatus. In the calibration operation, the tint or color misregistration of the image is corrected by a method including forming a calibration patch image on a photosensitive drum, transferring the formed patch image onto an intermediate transfer belt, and detecting the patch image on the intermediate transfer belt.

Here, to form the calibration patch image in the initial operation, all of the developing rollers are required to be actually in contact with the respective photosensitive drums. Therefore, after starting driving of a main motor, the image forming apparatus first causes the separation mechanism to operate to shift from the "standby state" to the "full-color image forming state" (period "a" in FIG. 25). With this shift, all of the developing rollers are actually brought into contact with the respective photosensitive drums, so that, at this time, the state of the separation mechanism becomes coincident with the actual contact/separation state of the photosensitive drum and the developing roller. Then, the image forming apparatus transfers toner, which has adhered to each photosensitive drum during contact of each developing roller, onto the intermediate transfer belt, and cleans the intermediate transfer belt to remove the toner. To perform such transfer and cleaning, the image forming apparatus causes the separation mechanism to operate to shift from the "full-color image forming state" to the "mono-color image forming state" (period "b" in FIG. 25) and then from the "mono-color image forming state" to the "standby state" (period "c" in FIG. 25). In that state, the image forming apparatus performs cleaning of the intermediate transfer belt (period "θ1" in FIG. 25), and then causes the separation mechanism to operate again to shift from the "standby state" to the "full-color image forming state" (period "d" in FIG. 25). After that, the image forming apparatus performs an exposure operation to form a calibration patch image.

Then, after performing the calibration operation, the image forming apparatus cleans the intermediate transfer belt to remove the patch image. To perform such cleaning, the image forming apparatus causes the separation mechanism to operate again to shift from the "full-color image forming state" to the "mono-color image forming state" (period "e" in FIG. 25) and then from the "mono-color image forming state" to the "standby state" (period "f" in FIG. 25). In that state, the image forming apparatus performs cleaning of the intermediate transfer belt (period "θ2" in FIG. 25), and then stops the main motor to terminate the initial operation.

As mentioned above, prior to performing an exposure operation to form a calibration patch image, the image forming apparatus would require a waiting time by an operating time of the separation mechanism (period "a" to period "d" in FIG. 25) plus a cleaning time of the intermediate transfer belt (period "θ1" in FIG. 25). Therefore, it would be understood that the time required for the initial operation lengthens by the waiting time.

Furthermore, as the driving time for the initial operation increases, the rotation time of the main motor also increases, thus affecting the operating life of the main body of the image forming apparatus.

SUMMARY OF THE INVENTION

The present invention is directed to an image forming apparatus capable of shortening a time required prior to an image forming operation.

According to an aspect of the present invention, an image forming apparatus includes a process cartridge including a photosensitive member and a developing roller configured to develop a latent image formed on the photosensitive member, a mounting portion to and from which the process cartridge is attachable and detachable, a separation mechanism configured to take a first position to separate the developing roller from the photosensitive member and a second position to bring the developing roller into contact with the photosensitive member, an allowance mechanism configured to allow the process cartridge with the developing roller kept in contact with the photosensitive member to be mounted on the mounting portion when the separation mechanism is in the first position, an exposure device configured to expose the photosensitive member, and a control unit configured to determine whether the developing roller and the photosensitive member of the process cartridge are in contact with each other and to control operations of the separation mechanism and the exposure device based on a result of determination, wherein the control unit, when determining that the developing roller and the photosensitive member are in contact with each other when the separation mechanism is in the first position, performs an exposure operation to cause the exposure device to expose the photosensitive member while keeping the separation mechanism in the first position during an initial operation of the image forming apparatus.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. Dimensions, materials, shapes, and relative positions of components described in the following exemplary embodiments can be changed or modified according to configurations and various conditions of apparatuses to which the present invention is applied. Therefore, unless otherwise specified, the scope of the present invention should not be construed as being limited only to those described below.

<Image Forming Apparatus>

Figure 1:
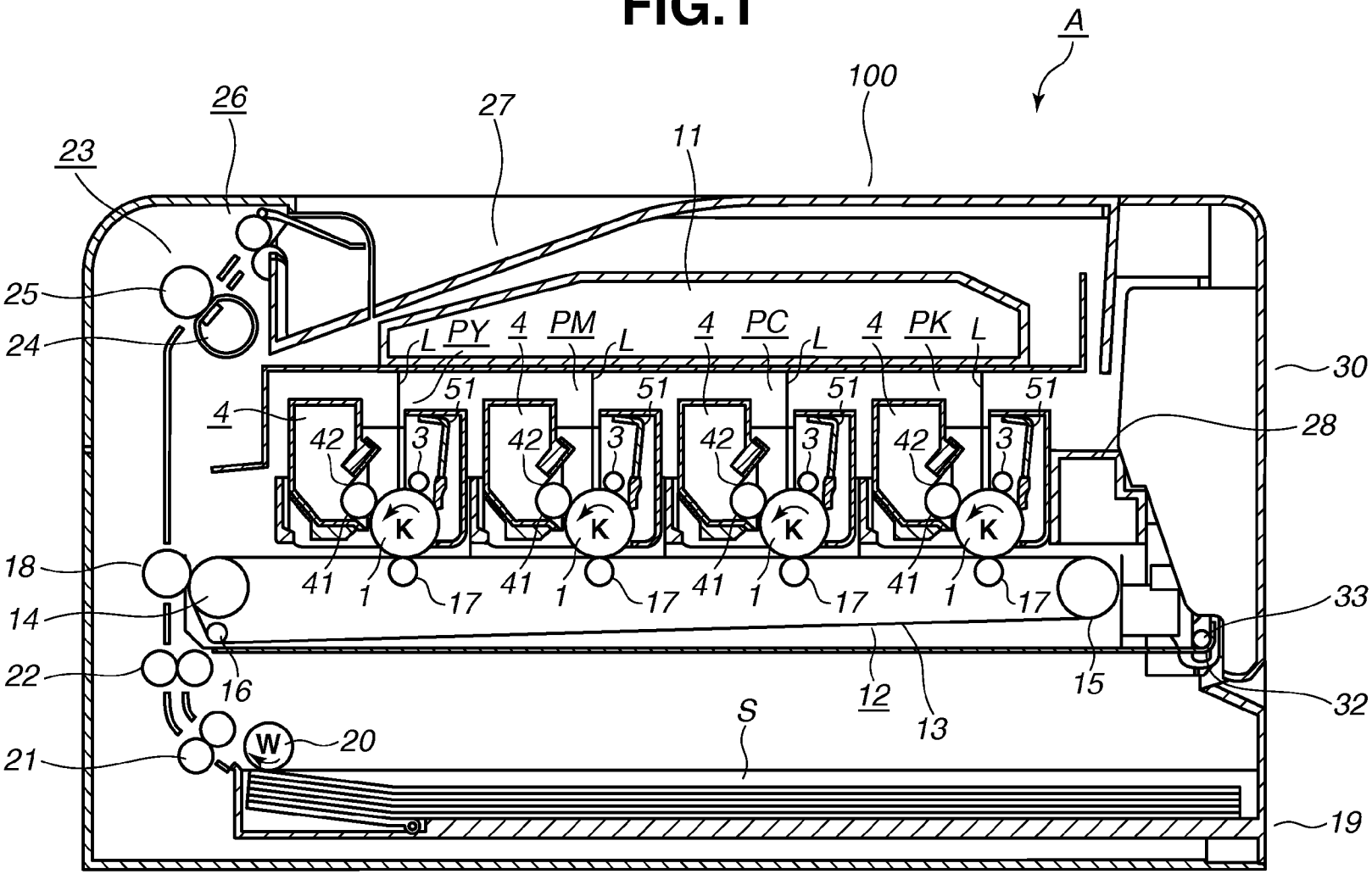
FIG. 1 illustrates an image forming apparatus according to a first exemplary embodiment.

FIG. 1 is a schematic configuration diagram illustrating a color image forming apparatus 100 according to a first exemplary embodiment of the present invention.

The image forming apparatus 100 includes a laser scanner 11, an intermediate transfer belt 13, a fixing film 24, a pressure roller 25, a sheet feed tray 19, and a sheet feed roller 20.

Four process cartridges P (PY, PM, PC, and PK), including a first process cartridge PY, a second process cartridge PM, a third process cartridge PC, and a fourth process cartridge PK, are arranged in the horizontal direction inside the image forming apparatus 100. The first to fourth process cartridges P (PY, PM, PC, and PK) include respective electrophotographic image forming process mechanisms that are similar except for colors of developers.

Each of the first to fourth process cartridges P (PY, PM, PC, and PK) includes a developing unit 4 equipped with a developing roller 41, which develops an electrostatic latent image on a photosensitive drum 1 (a hollow (drum-shaped) photosensitive member), which serves as an image bearing member.

The first process cartridge PY, which contains yellow (Y) toner inside the developing unit 4, forms a developer image of yellow on the surface of the photosensitive drum 1.

The second process cartridge PM, which contains magenta (M) toner inside the developing unit 4, forms a developer image of magenta on the surface of the photosensitive drum 1.

The third process cartridge PC, which contains cyan (C) toner inside the developing unit 4, forms a developer image of cyan on the surface of the photosensitive drum 1.

The fourth process cartridge PK, which contains black (K) toner inside the developing unit 4, forms a developer image of black on the surface of the photosensitive drum 1.

A sheet of paper (recording medium) S stacked and stored in the sheet feed tray 19 is fed by the sheet feed roller 20, which rotates clockwise (in the direction of arrow W) in FIG. 1, and is then conveyed to a contact portion (nip portion) between a belt driving roller 14 and a secondary transfer roller 18 via conveyance roller pairs 21 and 22.

The photosensitive drum 1 rotates counterclockwise (in the direction of arrow K) in FIG. 1. An electrostatic latent image is sequentially formed on the outer circumferential surface of the photosensitive drum 1 with a laser beam L emitted from the laser scanner (exposure unit, exposure device) 11. Then, the electrostatic latent image is developed by the developing roller 41 into a toner image (developer image) on the photosensitive drum 1.

The toner image formed on the photosensitive drum 1 is transferred onto the intermediate transfer belt 13 by a primary transfer roller 17, which is located opposite the photosensitive drum 1 via the intermediate transfer belt 13, which serves as an intermediate transfer member. In a case where the image forming apparatus 100 forms a color image, latent images for respective colors, yellow, magenta, cyan, and black, are developed on the respective photosensitive drums 1, and the thus-formed toner images are sequentially transferred onto the intermediate transfer belt 13.

The toner image formed on the intermediate transfer belt 13 is transferred onto the sheet S, which has been conveyed to the nip portion between the belt driving roller 14 and the secondary transfer roller 18.

Then, the sheet S having the transferred toner image is conveyed to a nip portion between the fixing film 24 and the pressure roller 25, at which the toner image is heated and pressed to be fixed to the sheet S. The sheet S having the fixed toner image is discharged onto a discharge tray 27 by a discharge roller pair 26.

<Method for Replacing Process Cartridges>

A method for replacing process cartridges P is described below.

A member that moves while holding the process cartridges PY, PM, PC, and PK is hereinafter referred to as a "cartridge tray 28". The cartridge tray 28 is a loading member on which to load and place the process cartridges PY, PM, PC, and PK. The cartridge tray 28 is supported by a cartridge tray holding member (hereinafter referred to as a "tray holding member) 32 and is mounted to be slidable in the horizontal directions in FIG. 2 (the directions of arrows M and N) with respect to the image forming apparatus 100.

Figure 2:
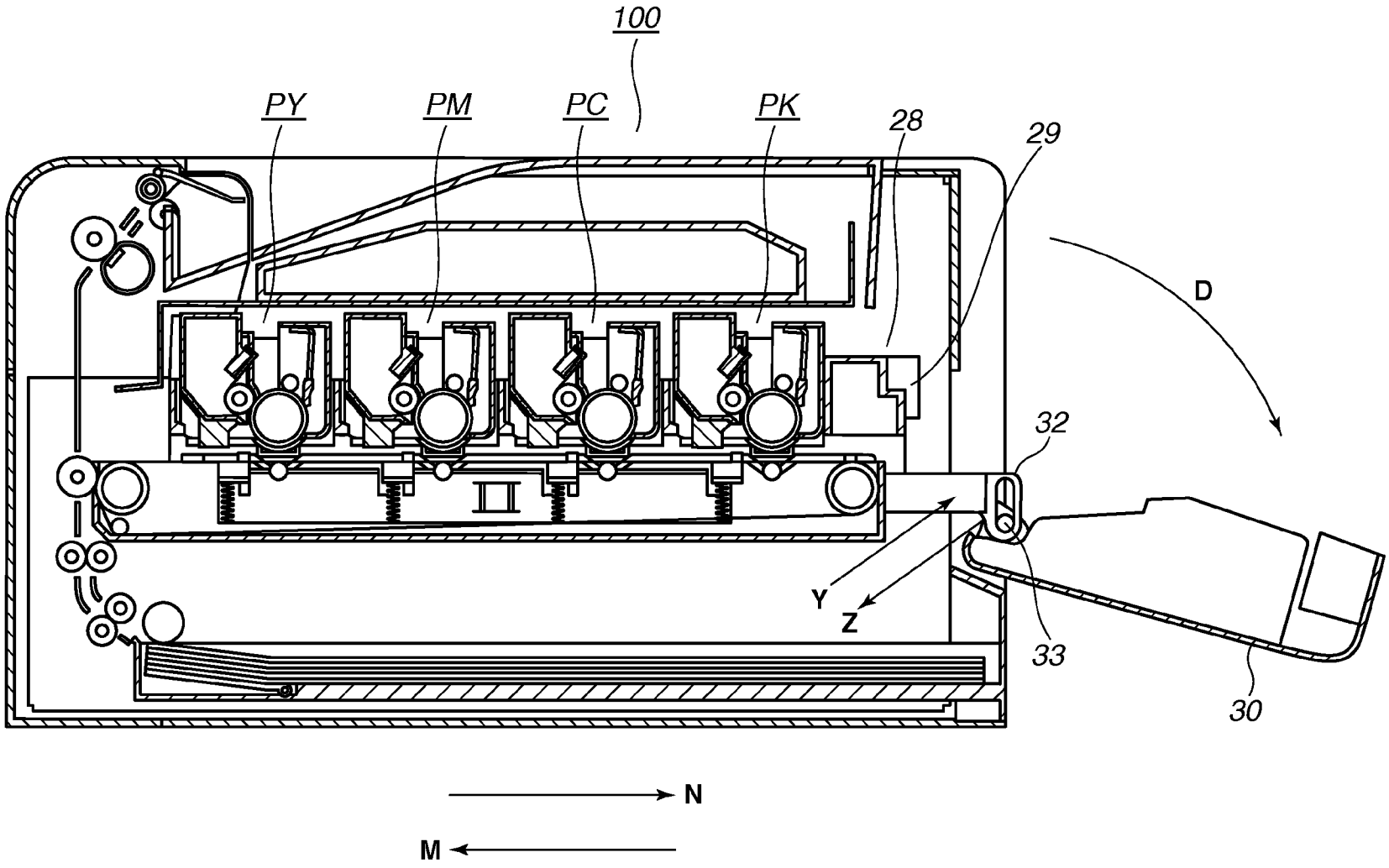
FIG. 2 is a sectional view illustrating the image forming apparatus according to the first exemplary embodiment.

As illustrated in FIG. 2, a space inside the image forming apparatus 100 serves as a mounting portion for the process cartridges P. The process cartridges P, when loaded and placed on the cartridge tray 28, are moved toward the mounting portion and are then mounted in the image forming apparatus 100. In addition, the process cartridges P are attachable to and detachable from the mounting portion of the image forming apparatus 100.

An opening and closing door (opening and closing member) 30 is mounted to be swingable with respect to the image forming apparatus 100. The opening and closing door 30 is illustrated as opened in FIG. 2. The opening and closing door 30 is an opening and closing member used to open and close an opening through which the cartridge tray 28 can pass. The user can open the opening and closing door 30 in the direction of arrow D in FIG. 2, thus becoming able to access a cartridge tray knob portion (hereinafter referred to as a "knob portion") 29.

An interlinking arm 33 is mounted to interlink the opening and closing door 30 and the tray holding member 32. The interlinking arm 33 and the tray holding member 32 constitute an interlocking mechanism (interlocking unit) that moves the cartridge tray 28 in conjunction with a swinging action of the opening and closing door 30. More Specifically, when the opening and closing door 30 is opened from a closed state, the interlinking arm 33 pulls the tray holding member 32 to the upper right (in the direction of arrow Y), thus moving the cartridge tray 28 upward in FIG. 2. At this time, the photosensitive drums 1 are separated from the intermediate transfer belt (transfer member) 13, so that the cartridge tray 28 becomes able to be drawn from the image forming apparatus 100. Thus, the user can draw the cartridge tray 28 from the image forming apparatus 100 by pulling the knob portion 29.

At this time, the process cartridges P placed on the cartridge tray 28 also move in a direction intersecting with the axial line of the photosensitive drum 1 (in the direction of arrow C in FIG. 3) to be drawn from the image forming apparatus 100.

The interlocking mechanism, which moves the cartridge tray 28 in conjunction with the swinging action of the opening and closing door 30, is described in detail below.

Figure 5B:
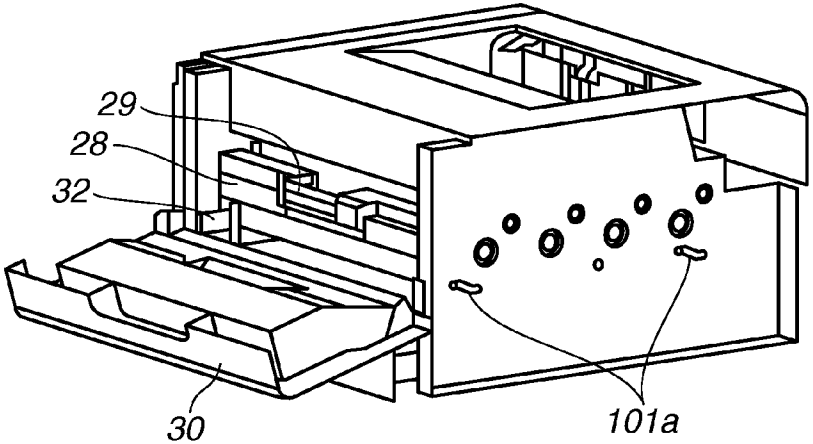
FIGS. 5A, 5B, and 5C are perspective views illustrating the image forming apparatus according to the first exemplary embodiment.
Figure 5C:
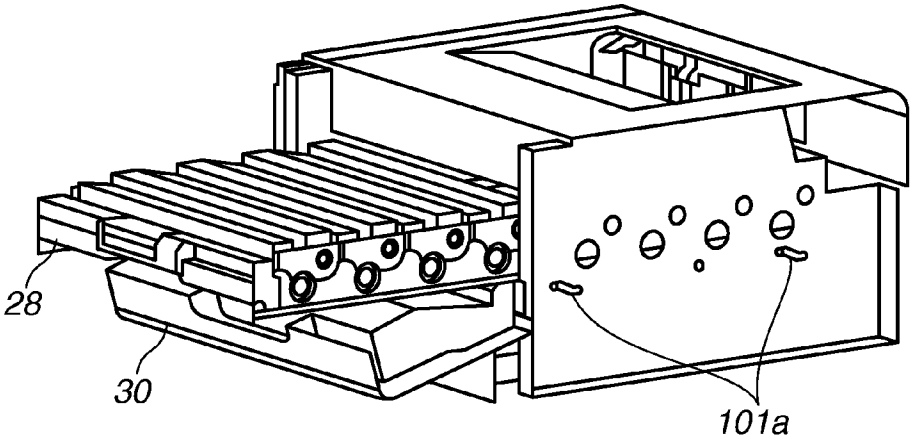
Figure 5A:
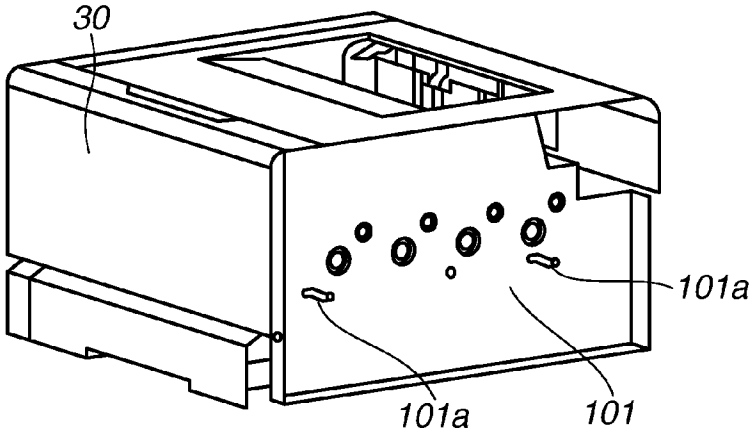
Figure 6A:
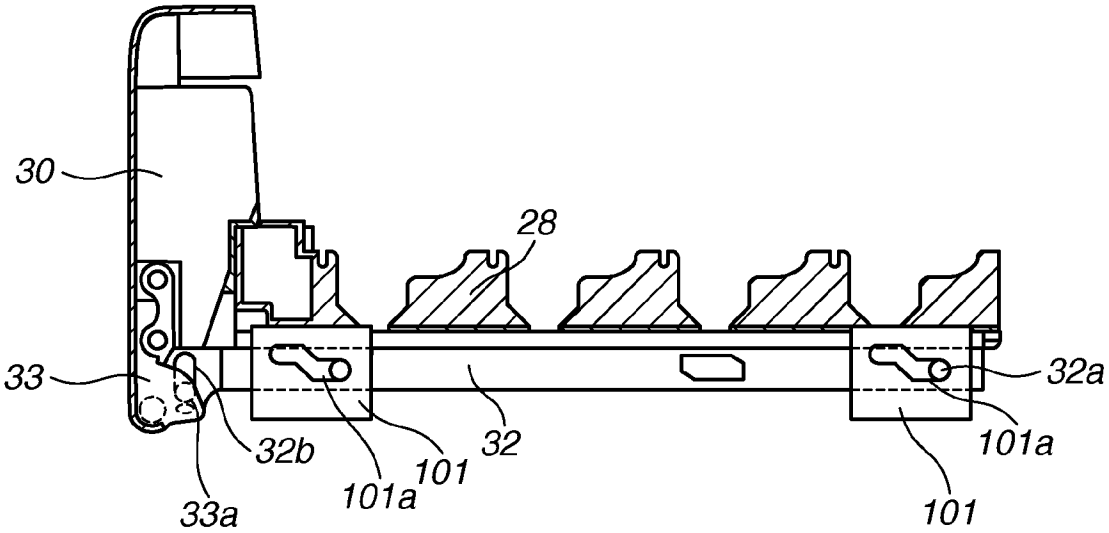
FIGS. 6A and 6B are sectional views illustrating states of an opening and closing door according to the first exemplary embodiment.
Figure 6B:
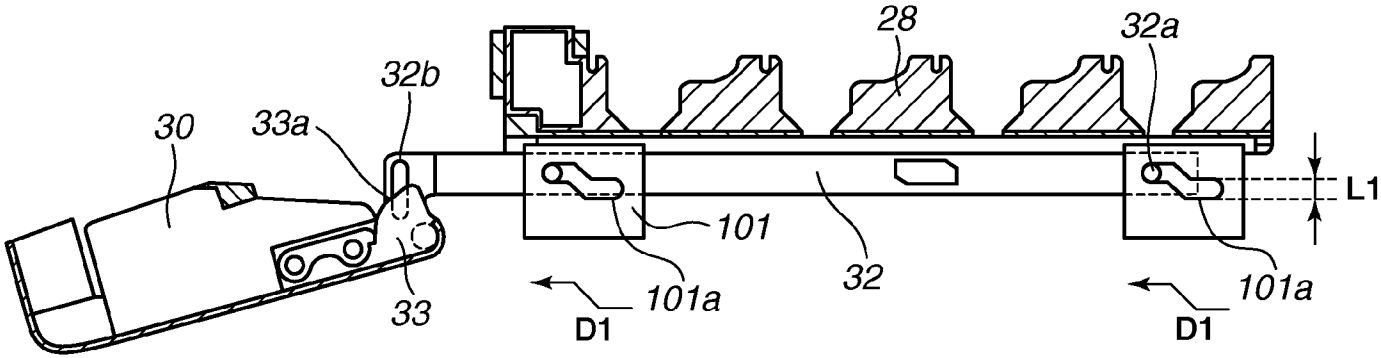

FIGS. 5A, 5B, and 5C are perspective views illustrating the image forming apparatus 100. FIG. 5A illustrates the image forming apparatus 100 with the opening and closing door 30 closed. FIG. 5B illustrates the image forming apparatus 100 with the opening and closing door 30 opened. FIG. 5C illustrates the image forming apparatus 100 with the cartridge tray 28 drawn from the inside of the image forming apparatus 100. FIGS. 6A and 6B are enlarged sectional views illustrating the opening and closing door 30 and the cartridge tray 28. FIG. 6A illustrates the cartridge tray 28 with the opening and closing door 30 closed. FIG. 6B illustrates the cartridge tray 28 with the opening and closing door 30 opened.

As illustrated in FIG. 6A, the interlinking arm 33 is mounted on the opening and closing door 30, and a boss 33*a* provided on the interlinking arm 33 engages with a slot 32*b* provided on the tray holding member 32. Accordingly, the tray holding member 33 moves in conjunction with the swinging action of the opening and closing door 30. More specifically, the tray holding member 32 includes bosses 32*a*, and the bosses 2*a* engage with slots 101*a* provided on the side plates 101 of the image forming apparatus 100. As the opening and closing door 30 is opened from the closed state (FIG. 6A), the tray holding member 32 moves in the direction of arrow D1 illustrated in FIG. 6B along the slots 101*a* of the side plates 101.

Each slot 101*a* of the side plates 101 has a step, so that the tray holding member 32 moves not only in the horizontal direction but also upward by a distance L1. Therefore, the cartridge tray 28, which is held by the tray holding member 32, also moves upward by the distance L1. In this instance, when there are process cartridges P placed on the cartridge tray 28, the photosensitive drums 1 become separated from the intermediate transfer belt 13.

With the image forming apparatus 100 in this state, when the user pulls the knob portion 29 illustrated in FIG. 5B, the cartridge tray 28 is drawn out of the image forming apparatus 100 as illustrated in FIG. 5C to be moved to a pullout position.

Figure 3:
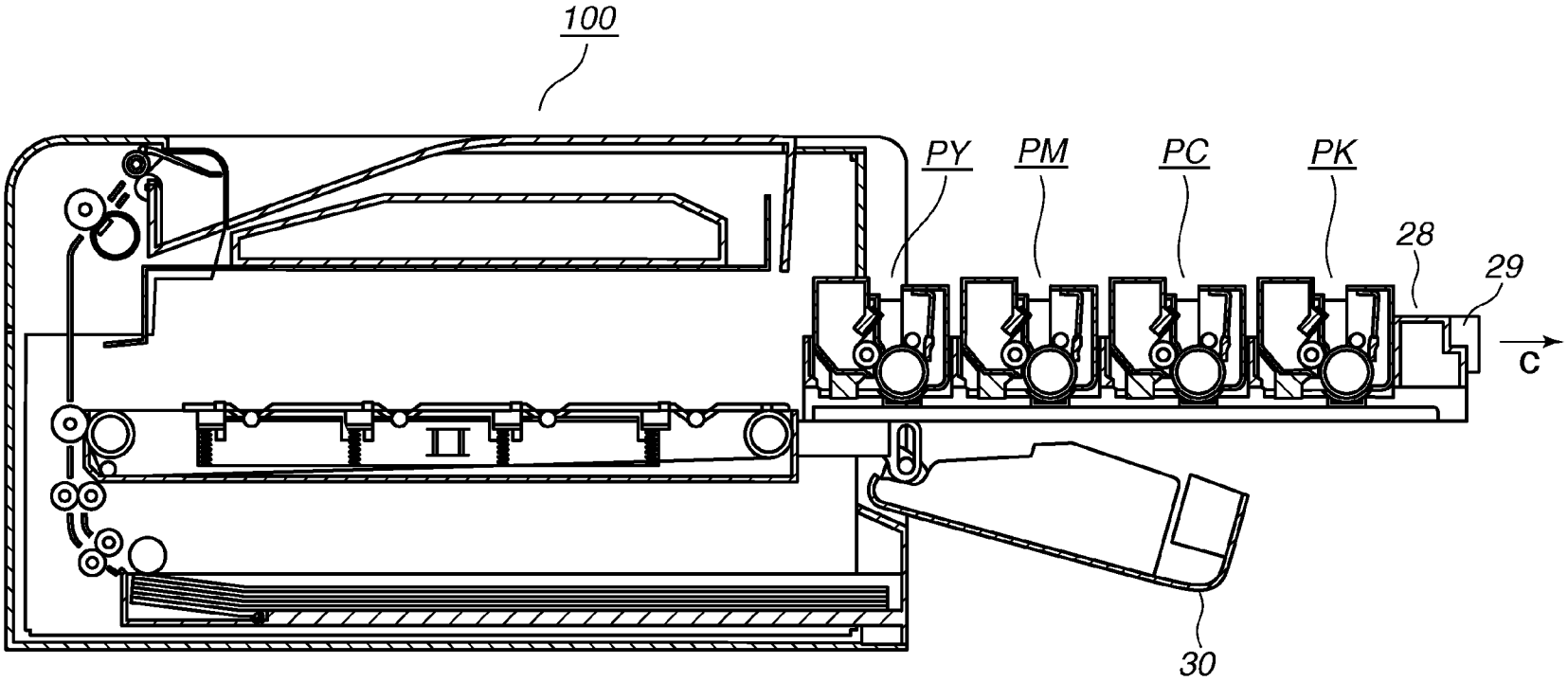
FIG. 3 is a sectional view illustrating the image forming apparatus according to the first exemplary embodiment.
Figure 4:
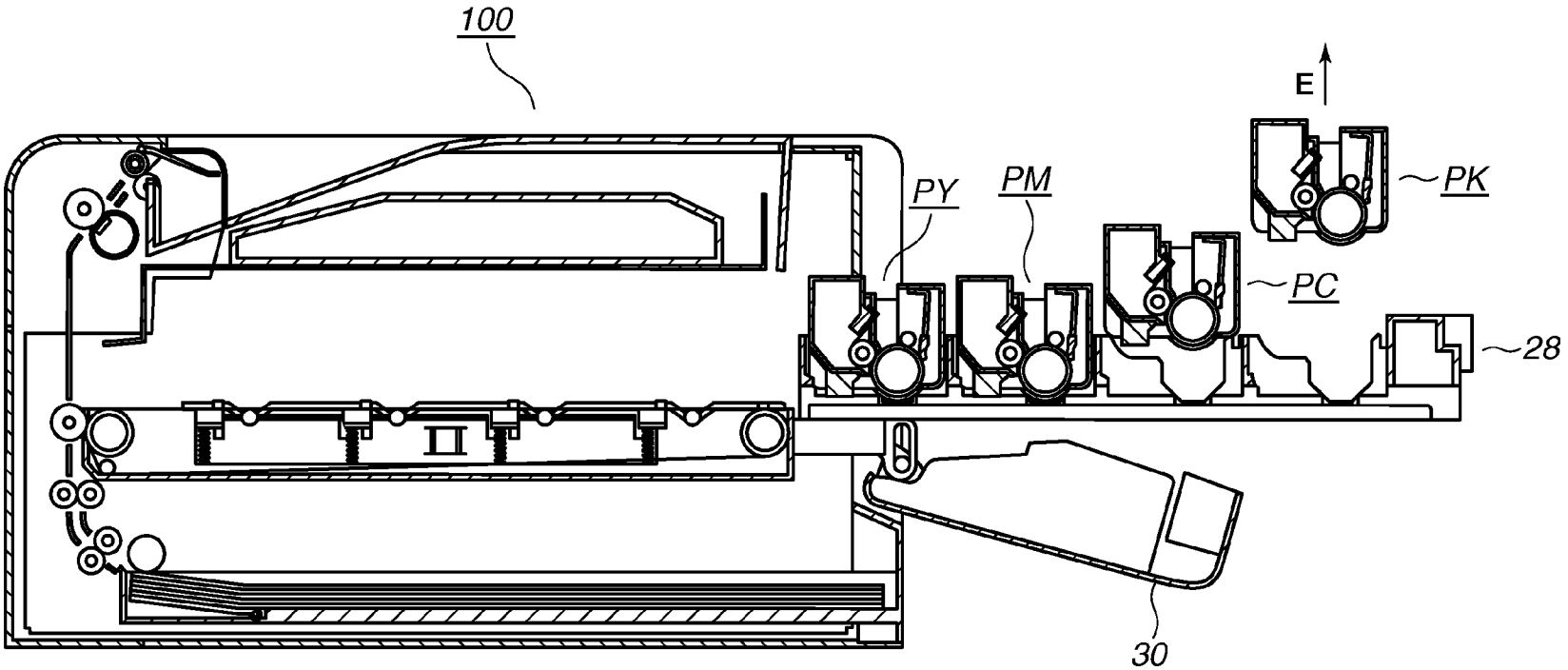
FIG. 4 is a sectional view illustrating the image forming apparatus according to the first exemplary embodiment.

FIG. 3 is a sectional view illustrating the image forming apparatus 100 with the cartridge tray 28 drawn out of the image forming apparatus 100 in the direction of arrow C. With the cartridge tray 28 in this state, the upper surfaces of the process cartridges PY, PM, PC, and PK become free from any cover, so that each of the process cartridges PY, PM, PC, and PK becomes detachable upward (in the direction of arrow E) as illustrated in FIG. 4.

To load and place the process cartridges P in the image forming apparatus 100, the user performs the opposite procedure, i.e., draws out the cartridge tray 28, places the process cartridges P on the cartridge tray 28, and then stows the cartridge tray 28 in the image forming apparatus 100. In this instance, the process cartridges P loaded and placed on the cartridge tray 28 also move in a direction intersecting with the axial line of the photosensitive drum 1 to be moved to the mounting portion.

Then, after stowing the cartridge tray 28 in the image forming apparatus 100, the user closes the opening and closing door 30 to push down the tray holding member 32 to the lower left (in the direction of arrow Z) in FIG. 2. This causes the cartridge tray 28 also to move downward, thus bringing the photosensitive drums 1 of the process cartridges P into contact with the intermediate transfer belt 13. In other words, as the user closes the opening and closing door 30, the cartridge tray 28 is mounted in the mounting position inside the image forming apparatus 100. At the same time, the photosensitive drums 1 of the process cartridges P are brought into contact with the intermediate transfer belt 13 to be placed at positions where image formation can be performed.

<Configuration of Process Cartridge>

Figure 7:
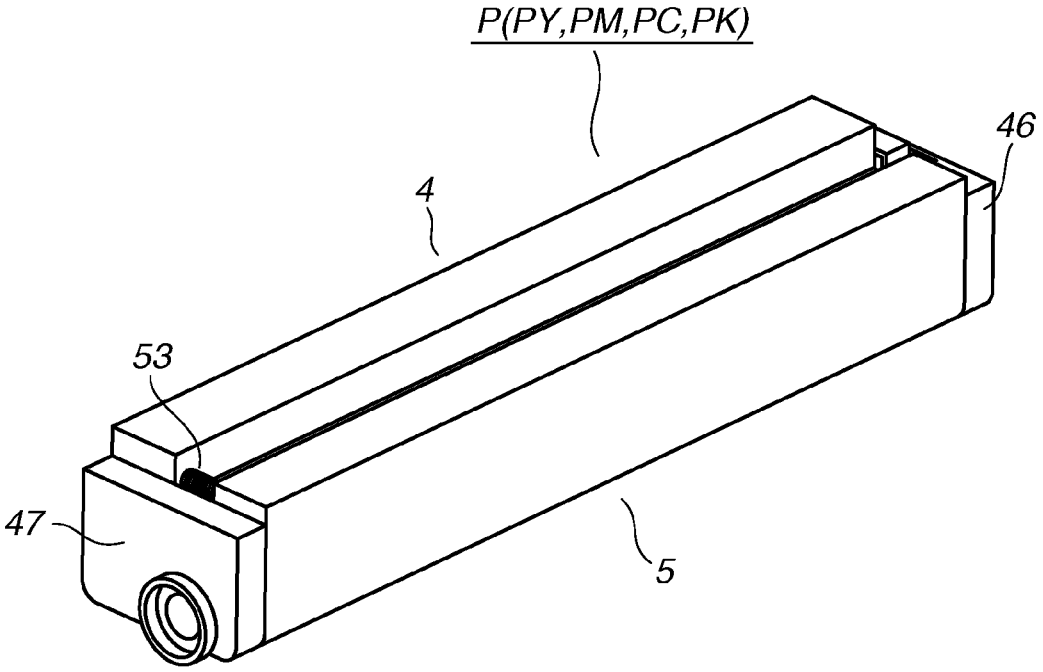
FIG. 7 is a perspective view illustrating a process cartridge according to the first exemplary embodiment.
Figure 8A:
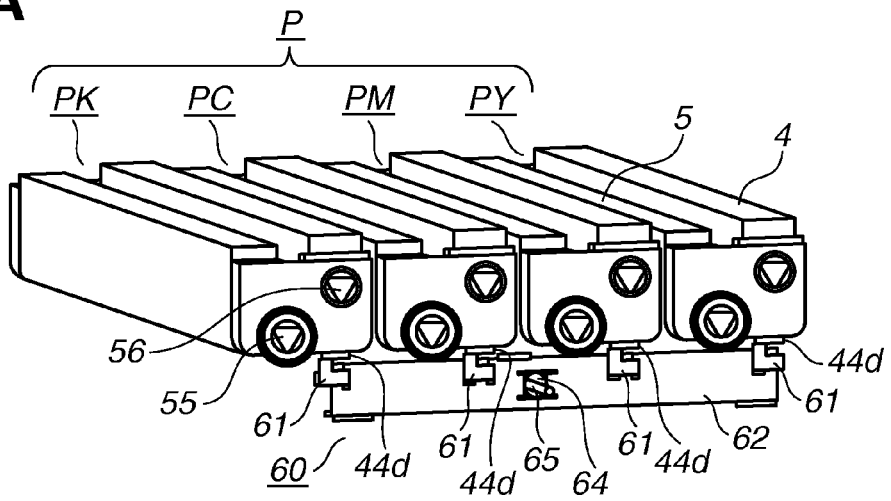
FIGS. 8A, 8B, and 8C are perspective views illustrating mounting states of the process cartridge according to the first exemplary embodiment.
Figure 8B:
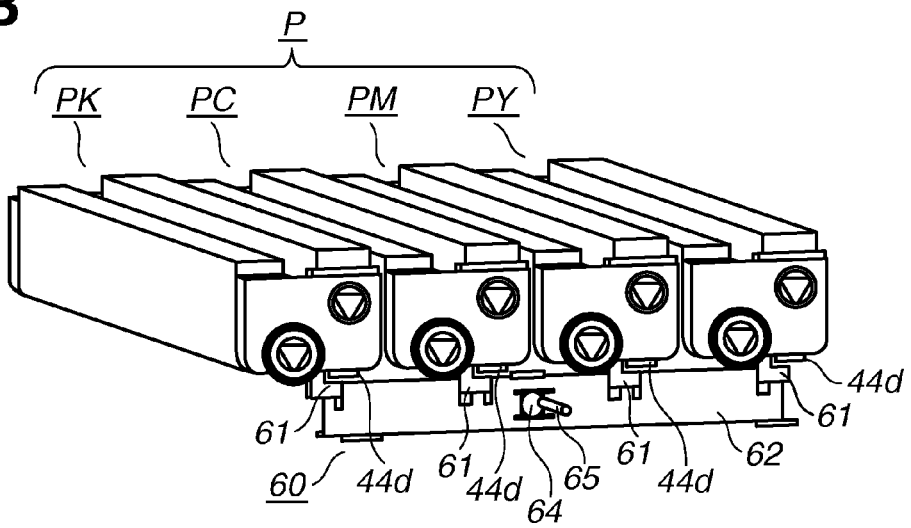
Figure 8C:
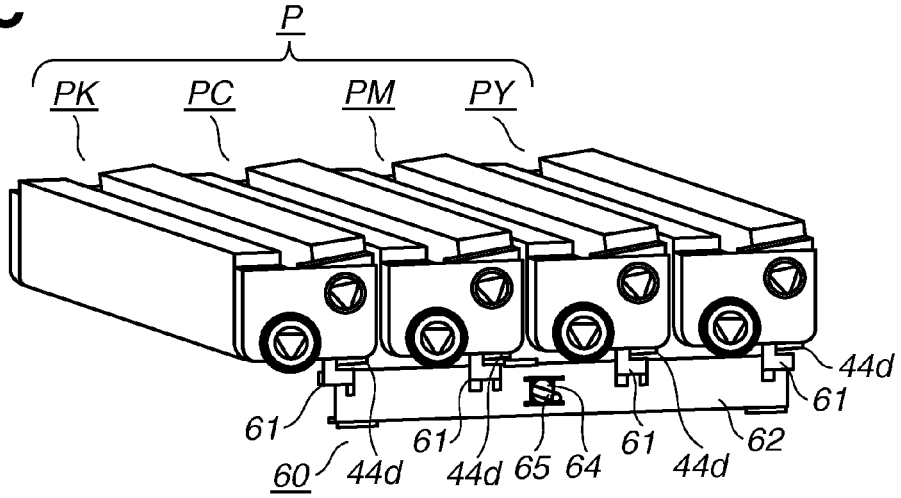

FIG. 7 is an external perspective view illustrating each of the process cartridges P (PY, PM, PC, and PK). FIGS. 8A, 8B, and 8C are perspective views illustrating the relationship between the process cartridges P and a separation mechanism 60. As mentioned in the foregoing, the process cartridges PY, PM, PC, and PK have electrophotographic process mechanisms that are similar except for colors of the contained toners or the amount of filled toner.

The process cartridge P is a rectangular boxy assembly with a longitudinal direction thereof set in the horizontal direction along the axial direction (longitudinal direction) of the photosensitive drum 1. The photosensitive drum 1 is arranged to be rotatable while being supported by a driving-side cartridge cover member 46, which is arranged at the right side portion of a cleaner unit 5, and a non-driving-side cartridge cover member 47, which is arranged at the left side portion of the cleaner unit 5. The driving-side axial end portion of the process cartridge P is provided with a drum coupling member 55 (illustrated in FIG. 8A), which serves as a photosensitive drum drive input portion, and a developing coupling member 56 (illustrated in FIG. 8A), which serves as a drive input portion for the developing roller 41 in the developing unit 4. The details of the drum coupling member 55 and the developing coupling member 56 are described below. The left side portion of the process cartridge P is provided with a cartridge electrical contact (not illustrated). In the above-described process cartridge P, the right side portion, which is provided with the drum coupling member 55 and the developing coupling member 56, to which driving forces are transmitted from the image forming apparatus 100, is a driving side, and the left side portion, which is opposite the right side portion, is a non-driving side.

Figure 9:
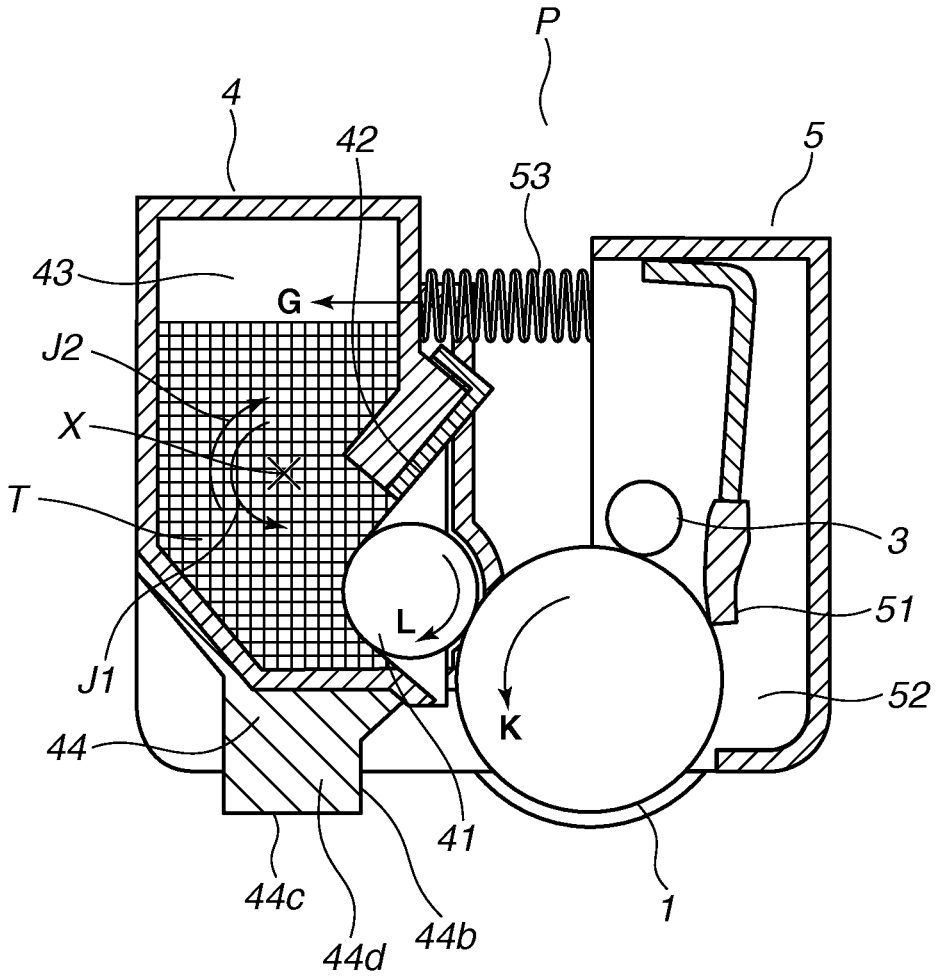
FIG. 9 is a sectional view illustrating the process cartridge according to the first exemplary embodiment.

FIG. 9 is a sectional view illustrating a section taken along a direction perpendicular to the axial direction of the photosensitive drum 1. Driving forces from the image forming apparatus 100 are transmitted to the drum coupling member 55 and the developing coupling member 56 (illustrated in FIG. 8A) of the process cartridge P. With these driving forces, the photosensitive drum 1 is driven to rotate at a predetermined speed counterclockwise (in the direction of arrow K) and the developing roller 41 is driven to rotate at a predetermined speed clockwise (in the direction of arrow L).

In the present exemplary embodiment, the process cartridge P includes the cleaner unit 5 and the developing unit 4, which is swingably coupled to the cleaner unit 5. The cleaner unit 5 is a first unit (photosensitive drum unit) that holds the photosensitive drum 1, and the developing unit 4 is a second unit that holds the developing roller 41.

A charging roller (charging member) 3 provided in the cleaner unit 5 is a charging member of the contact charging type, which is driven to rotate by contact with the photosensitive drum 1. A cleaning blade (cleaning member) 51, which is an elastic rubber blade, is arranged with a tip portion thereof kept in contact with the photosensitive drum 1. The cleaning blade 51 functions to remove toner remaining on the photosensitive drum 1. Transfer residual toner removed by the cleaning blade 51 is stored in a toner storage portion 52 provided in the cleaner unit 5.

The developing unit 4 includes the developing roller 41, which serves as a developing unit, and a developing blade 42. The developing unit 4 further includes a developing chamber (toner storage portion) 43, which stores toner.

As illustrated in FIG. 9, the developing roller 41 is located in the developing chamber 43, and the developing blade 42 is located with a tip portion thereof kept in contact with the developing roller 41. The developing blade 42 functions to keep a thin layer of toner on the circumferential surface of the developing roller 41.

The developing unit 4 is urged by a pressure spring 53, which is an elastic member, to be swingable around the swinging axis X in such a way as to keep the developing roller 41 in contact with the photosensitive drum 1. More specifically, the developing unit 4 is pressed in the direction of arrow G illustrated in FIG. 9 by the urging force of the pressure spring 53 to exert a moment in the direction of arrow J1 around the swinging axis X. This moment enables the developing roller 41 to contact the photosensitive drum 1 at a predetermined pressure. The position of the developing unit 4 with respect to the cleaner unit 5 at that time is referred to as the "contact position".

A bearing member 44 is arranged at the end portion of the developing unit 4 in the axial direction (longitudinal direction) of the developing roller 41. The bearing member 44 has a protruding portion 44*d*. The protruding portion 44*d* protrudes in a direction intersecting with the axial line of the developing roller 41 and in a direction away from the developing roller 41. The protruding portion 44*d* has a force receiving portion 44*b*, which receives force by contacting the separation mechanism 60 (illustrated in FIGS. 8A, 8B, and 8C) provided in the image forming apparatus 100. The force receiving portion 44*b* receiving force from the separation mechanism 60 enables a contact/separation operation between the developing unit 4 and the cleaner unit 4, i.e., a contact/separation operation between the developing roller 41 and the photosensitive drum 1, to be performed.

<Separation Mechanism in Image Forming Apparatus>

The separation mechanism 60 provided in the image forming apparatus 100 is described below.

As described in the foregoing, the developing unit 4 is urged by the pressure spring 53 provided in the process cartridge P and is thus located in the contact position to bring the developing roller 41 into contact with the photosensitive drum 1. However, a long-time contact between the developing roller 41 and the photosensitive drum 1 may cause a depression to be left on the developing roller 41, thus affecting an image. Therefore, it is desirable that the developing roller 41 and the photosensitive drum 1 are separated from each other when image formation is not being performed. Therefore, the image forming apparatus 100 according to the present exemplary embodiment is equipped with the separation mechanism 60, which functions to separate the developing roller 41 from the photosensitive drum 1.

Figure 10A:
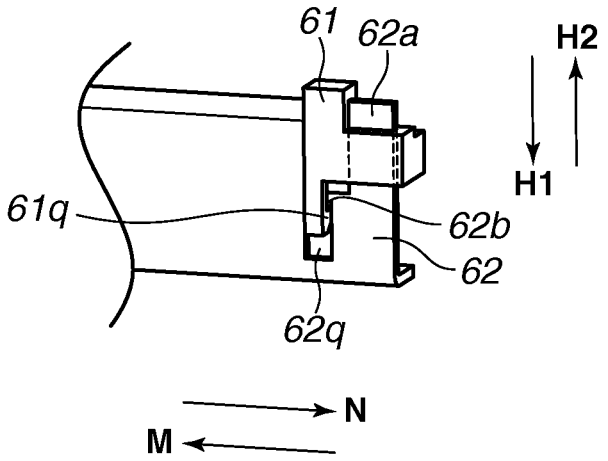
FIGS. 10A, 10B, and 10C illustrate a moving member and a retraction member according to the first exemplary embodiment.
Figure 10B:
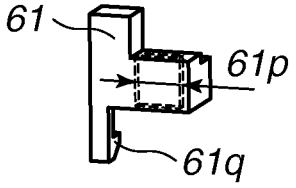
Figure 10C:
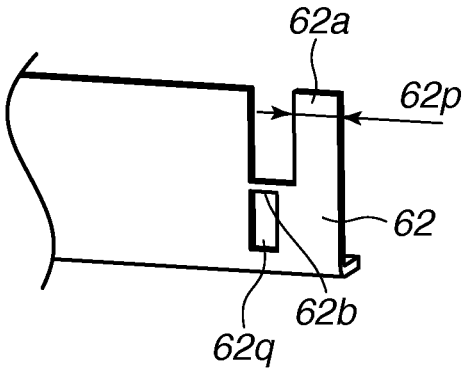
Figure 11A:
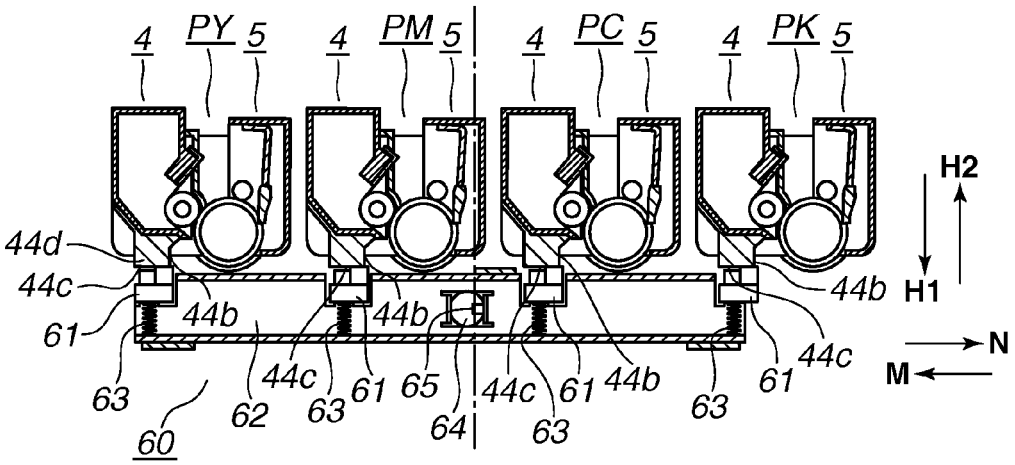
FIGS. 11A, 11B, and 11C are sectional views illustrating the relationship between the process cartridge and a separation mechanism according to the first exemplary embodiment.
Figure 11B:
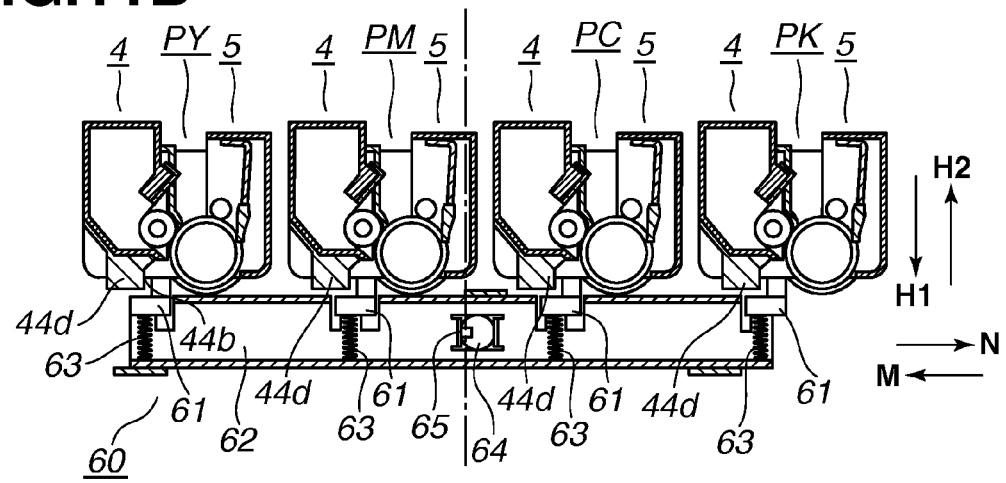
Figure 11C:
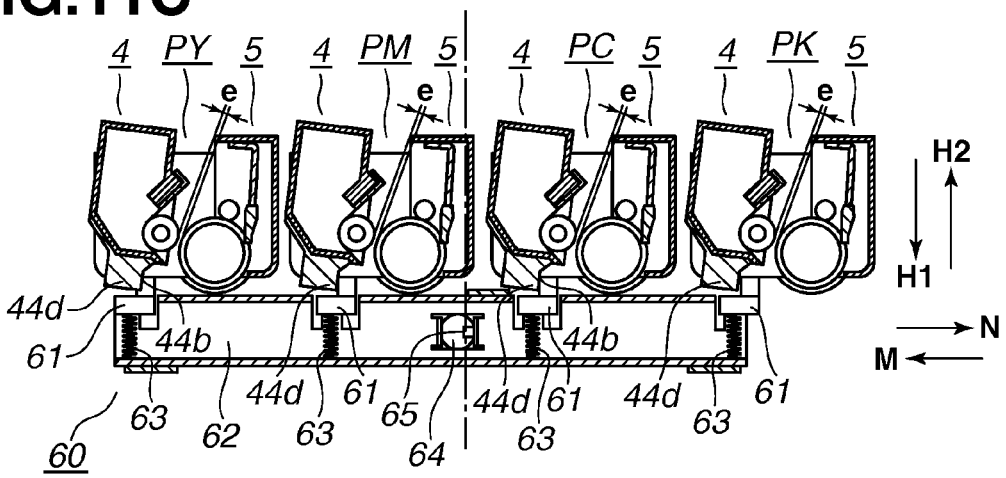

FIGS. 11A, 11B, and 11C are sectional views illustrating the relationship between the process cartridges P and the separation mechanism 60. FIGS. 10A, 10B, and 10C are partial enlarged views of the separation mechanism 60. FIG. 10A illustrates a retraction member 61 and a moving member 62 assembled together. FIG. 10B illustrates the retraction member 61. FIG. 10C illustrates the moving member 62.

The retraction member 61, which is L-shaped, is an engagement member that engages with the process cartridge P. Thus, the retraction member 61 engages with (contacts) the force receiving portion 44*b*, which is an engaged portion of the process cartridge P, to exert a force on the force receiving portion 44*b*.

The retraction member 61 is able to move with respect to the moving member 62 in the height directions of the image forming apparatus 100 (the vertical directions, i.e., the directions of arrow H1 and arrow H2). Thus, as illustrated in FIG. 10A, the retraction member 61 is supported by a support portion (hereinafter referred to as a "guide portion") 62*a* of the moving member 62 to be movable (slidable) in the directions of arrow H1 and arrow H2. More specifically, a hole portion 61*p* of the retraction member (engagement member) 61 is engaged with a shaft portion 62*p* of the moving member 62. Also, a latch portion 61*q* of the retraction member 61 is located in a latch hole 62*q* of the moving member 62. The latch portion 61*q* of the retraction member 61, when engaging with a restriction portion 62*b* of the moving member 62, prevents the retraction member 61 from dropping off the moving member 62.

Furthermore, the retraction member 61 is urged by an urging spring 63, which is an elastic member attached to the moving member 62, toward a position where the retraction member 61 can engage with the force receiving portion 44*b* (engagement position), as illustrated in FIGS. 11A, 11B, and 11C). Thus, the urging spring 63 serves as an urging member that urges the retraction member 61 toward the engagement position.

The moving member 62, which is located below the process cartridges P (PY, PM, PC, and PK), is arranged to be movable in the image forming apparatus 100. The moving member 62 is provided with a circular cam 64. A cam drive shaft 65 is interlinked with the circular cam 64 at a position away from the center of the circle of the cam 64. The cam 64 rotates around the cam drive shaft 65, as a rotational center, by receiving a drive force from a drive source (a cam motor 96 in FIG. 13) provided in the image forming apparatus 100, to move the moving member 62 approximately in the horizontal directions (the left-right directions, i.e., the directions of arrow M and arrow N in FIGS. 11A, 11B, and 11C).

According to the rotation of the cam 64, the moving member 62 moves between a position to separate the developing roller 41 and the photosensitive drum 1 from each other and a position to allow the developing roller 41 and the photosensitive drum 1 to contact each other in all of the first to fourth process cartridges P (PY, PM, PC, and PK). Hereinafter, the position to separate the developing roller 41 and the photosensitive drum 1 from each other is referred to as a "first position", and the position to allow the developing roller 41 and the photosensitive drum 1 to contact each other is referred to as a "second position".

<Contact/Separation Operation of Developing Unit>

Next, the behavior of the retraction member 61 when the process cartridges P are mounted in the image forming apparatus 100 and the operation of the separation mechanism 60 separating the developing roller 41 and the photosensitive drum 1 from each other are specifically described.

Figure 12:
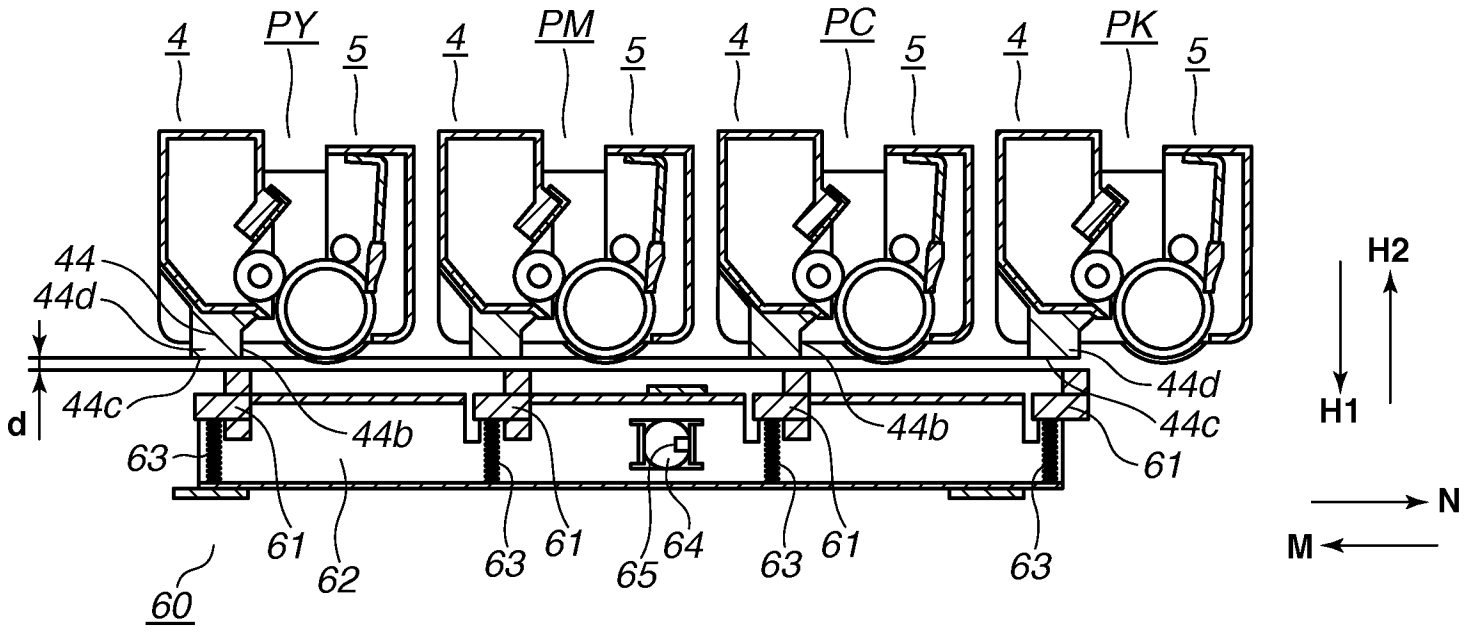
FIG. 12 is a sectional view illustrating a mounting state of the process cartridge according to the first exemplary embodiment.

FIG. 12 illustrates the process cartridges P and the separation mechanism 60 when the cartridge tray 28 and the process cartridges P are mounted in the image forming apparatus 100. As described in the foregoing, when the opening and closing door 30 is in the opened state, the cartridge tray 28 has moved upward (in the direction of arrow H2) (has moved to the upper right, i.e., in the direction of arrow Y in FIG. 2). At this time, a clearance "d" is present between the retraction member 61 and the protruding portion 44*d* of the bearing member 44. Accordingly, even if, in this state, the cartridge tray 28 and the process cartridges P are moved in the horizontal directions (the directions of arrow M and arrow N), the retraction member 61 does not interfere with the bearing members 44.

After inserting the cartridge tray 28 and the process cartridges P into the image forming apparatus 100, the user closes the opening and closing door 30. As described in the foregoing, the process cartridges P move to the lower left (in the direction of arrow Z in FIG. 2) in the image forming apparatus 100 in conjunction with the closing operation of the opening and closing door 30, so that the photosensitive drums 1 come into contact with the intermediate transfer belt 13. At this time, the moving member 62 is in the first position illustrated in FIG. 8A and FIG. 11A, and each of the retraction members 62, which are supported by the moving member 62, is in a position to interfere with the associated process cartridge P.

However, the urging spring 63 is attached to the retraction member 61. Therefore, as the retraction member 61 interferes with the process cartridge P and is pressed by a pressing portion 44*c* of the process cartridge P, the retraction member 61 moves approximately in parallel with the moving direction of the process cartridge P (the direction of arrow H1) due to the urging spring 63 being compressed. In other words, the retraction member 61 retracts (moves to the retraction position) by being pressed by the pressing portion 44*c*, thus allowing the process cartridge P to move.

Thus, even in a case where the moving member 62 of the separation mechanism 60 is in the first position (originally, the position to separate the developing roller 41 from the photosensitive drum 1), the retraction of the retraction member 61 enables the process cartridges P to be mounted with the developing roller 41 kept in contact with the photosensitive drum 1. The retraction member 61 and the urging member 63 serve as an allowance mechanism that allows mounting of the process cartridges P with the developing roller 41 kept in contact with the photosensitive drum 1.

As the retraction member 61 retracts in this way, the process cartridges P are mounted in a predetermined position in the image forming apparatus 100. The pressing portion 44*c* is formed on an end surface of the protruding portion 44*d*, which protrudes from the developing unit 4.

Next, the force receiving portion 44*b* of the protruding portion 44*d* and the retraction member 61 are caused to engage with each other. To this end, the moving member 62 is temporarily moved to the right (in the direction of arrow N) in FIG. 11A. Then, the moving member 62 is moved up to a position to cause the retraction member 61 and the protruding portion 44*d* not to interfere with each other (the second position). When the moving member 62 has moved up to the second position, where the retraction member 61 does not interfere with the protruding portion 44*d*, as illustrated in FIG. 8B and FIG. 11B, the retraction member 61 moves upward (in the direction of arrow H2) due to the extension of the urging spring 63. This shifts the retraction member 61 to a position to allow the retraction member 61 to engage with the force receiving portion 44*b* (the engagement position).

Next, as the moving member 62 moves to the left (in the direction of arrow M) in FIG. 11B, the retraction member 61 engages with the force receiving portion 44*b* provided in the protruding portion 44*d*. As the moving member 62 further moves to the left (in the direction of arrow M) and returns to the first position, the moving member 62 exerts a force on the force receiving portion 44*b* via the retraction member 61. This causes each of the developing units 4 to move up to a position to separate the developing roller 41 from the photosensitive drum 1 with a clearance "e" (the separation position), as illustrated in FIG. 8C and FIG. 11C.

As illustrated in FIG. 10A, the retraction member 61 has moving directions with respect to the moving member 62 determined by the guide portion 62*a* and is thus able to slide only in the directions of arrow H1 and arrow H2. The moving directions of the retraction member 61 (the directions of arrow H1 and arrow H2) intersect with the moving directions of the moving member 62 (the directions of arrow M and arrow N). Therefore, when the moving member 62 moves, even if the retraction member 61 receives, from the force receiving portion 44*b*, a force in the direction of arrow M or N, the retraction member 61, which is supported by the guide portion 62*a*, is able to retain a state to engage with the force receiving portion 44*b*. This enables the moving member 62 to surely move the developing units 4 to the separation position to separate the developing roller 41 and the photosensitive drum 1 from each other. In the present exemplary embodiment, the moving directions of the retraction member 61 (the directions of arrow H1 and arrow H2) are approximately orthogonal to the moving directions of the moving member 62 (the directions of arrow M and arrow N).

In the present exemplary embodiment, when the image forming apparatus 100 does not perform image formation, which forms a toner image (developer image) on an electrostatic latent image portion of the photosensitive drum 1, the moving member 62 is set to the first position illustrated in FIG. 11C to prevent the developing roller 41 from being deformed due to the pressure of contact with the photosensitive drum 1. When the image forming apparatus 100 performs image formation, the moving member 62 is moved to the second position illustrated in FIG. 11B. At this time, the developing unit 4 moves from the separation position to the contact position due to the force from the pressure spring 53, thus bringing the developing roller 41 into contact with the photosensitive drum 1 (as illustrated in FIG. 11B). In this state, developer with which the developing roller 41 is coated is used to develop an electrostatic latent image formed on the photosensitive drum 1.

After the completion of image formation, the moving member 62 (the separation mechanism 60) is moved again to the first position to set a state in which the developing roller 41 is separated from the photosensitive drum 1 (standby state) (as illustrated in FIG. 11C) after a next image forming operation starts.

In this instance, when the process cartridges P are to be extracted from the image forming apparatus 100, as described above, the tray holding member 32 is moved upward by the distance L1 along the slots 101*a* of the side plates 101, illustrated in FIG. 6B, in conjunction with the swinging action of the opening and closing door 30. Then, along with this movement, the cartridge tray 28 and all of the first to fourth process cartridges P (PY, PM, PC, and PK), which are held by the cartridge tray 28, are also moved upward. This disengages the retraction member 61 and the force receiving portion 44*b*, which is provided in the projection portion 44*d*, from each other, thus bringing about a state in which the pressing portion 44*c* of the process cartridge P has run over the retraction member 61. This state is the same as the state illustrated in FIG. 11A, in which the developing rollers 41 of all of the first to fourth process cartridges P (PY, PM, PC, and PK) are brought into contact with the respective photosensitive drums 1.

Furthermore, when the process cartridges P are to be mounted in the image forming apparatus 100, as described above, the retraction member 61 is moved from the engagement position (illustrated in FIGS. 11B and 11C) to the retraction position (illustrated in FIG. 11A) by being pressed by the pressing portion 44*c* provided in the protruding portion 44*d*. Therefore, the developing roller 41 is kept in contact with the photosensitive drum 1, thus enabling performing image formation.

Accordingly, in the image forming apparatus 100 according to the present exemplary embodiment, when the process cartridges P are attached to or detached from the image forming apparatus 100, the developing rollers 41 of all of the first to fourth process cartridges P (PY, PM, PC, and PK) are kept in contact with the respective photosensitive drums 1, thus enabling performing image formation.

<Control of Initial Operation>

In the present exemplary embodiment, in a case where the image forming apparatus 100 detects that a new process cartridge P has been mounted therein or a process cartridge P has been replaced, the image forming apparatus 100 determines that the developing roller 41 is surely in contact with the photosensitive drum 1 in all of the first to fourth process cartridges P (PY, PM, PC, and PK). Then, in the initial operation, before causing the separation mechanism 60 to operate, the image forming apparatus 100 performs a supply operation for supplying toner, as developer, from the developing roller 41 to the photosensitive drum 1 (image forming operation).

The initial operation performed immediately after a new process cartridge P has been mounted or a process cartridge P has been replaced when the separation mechanism 60 of the image forming apparatus 100 is in the first position is specifically described below.

The configuration of a control unit that controls the initial operation is first described with reference to FIG. 13, and the flow of the initial operation by the control unit is next described with reference to FIG. 14.

Figure 13:
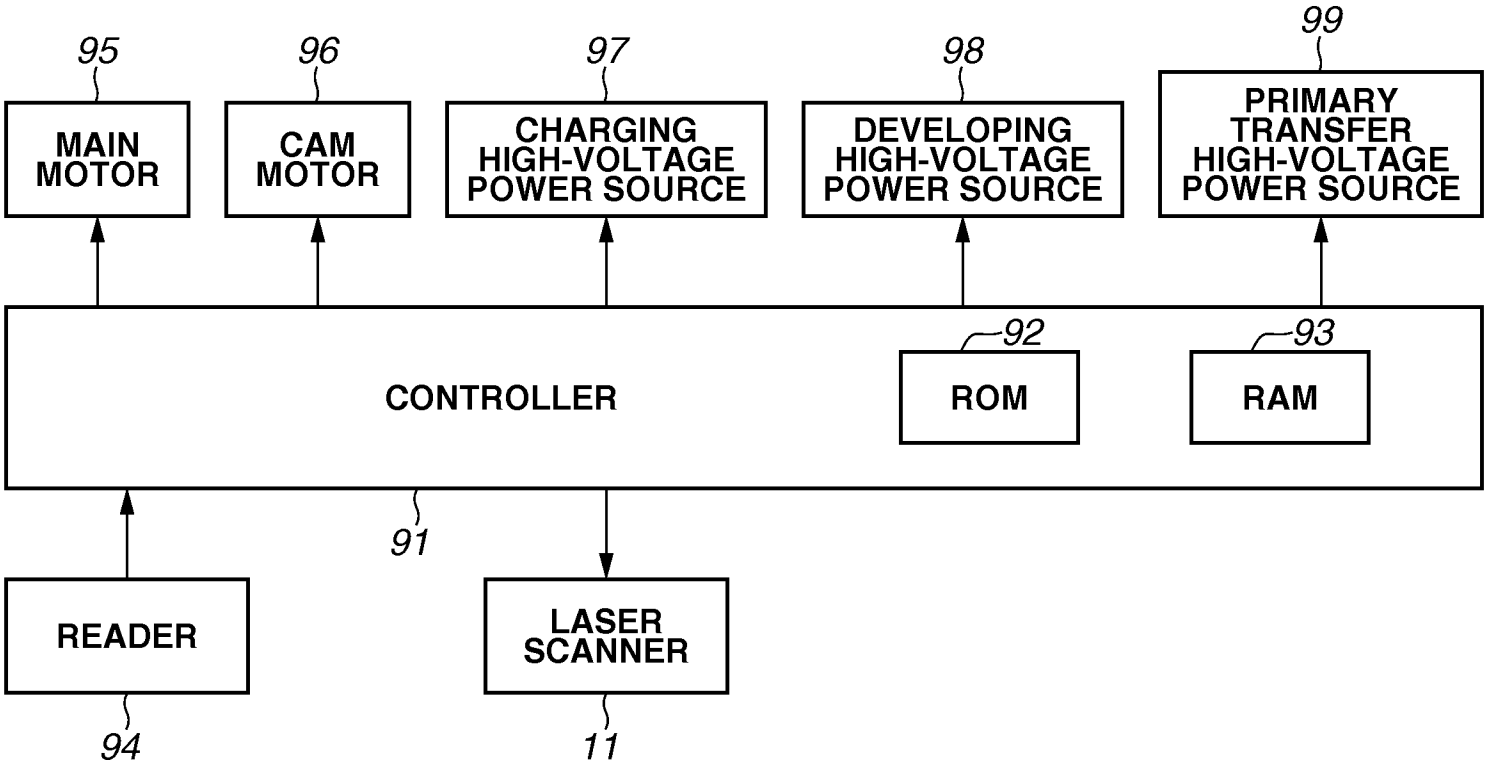
FIG. 13 is a block diagram illustrating a configuration of a control unit included in the image forming apparatus according to the first exemplary embodiment.

FIG. 13 is a block diagram illustrating a configuration of the control unit included in the image forming apparatus 100 according to the present exemplary embodiment. As illustrated in FIG. 13, a controller (control unit) 91, which is provided in the image forming apparatus 100, includes a central processing unit (CPU) (not illustrated), a read-only memory (ROM) 92, and a random access memory (RAM) 93. The controller 91 controls operations of a main motor 95, a cam motor 96, a laser scanner 11, and various high-voltage power sources 97, 98, and 99 based on control programs stored in the ROM 92 and information read out by a reader 94.

Referring to FIG. 13, the reader 94 is a reading unit that reads out information of a memory tag (memory capable of storing information about a cartridge) provided in each process cartridge P. The main motor 95 is a drive source that drives and rotates the photosensitive drum 1, the developing roller 41, and the intermediate transfer belt 13. The cam motor 96 is a drive source that drives and rotates the cam 64 to cause the separation mechanism 60 to operate. The charging high-voltage power source 97 is a power source that supplies a bias voltage to the charging roller 3. The developing high-voltage power source 98 is a power source that supplies a bias voltage to the developing roller 41. The primary transfer high-voltage power source 99 is a power source that supplies a bias voltage to the primary transfer roller 17.

Figure 14:
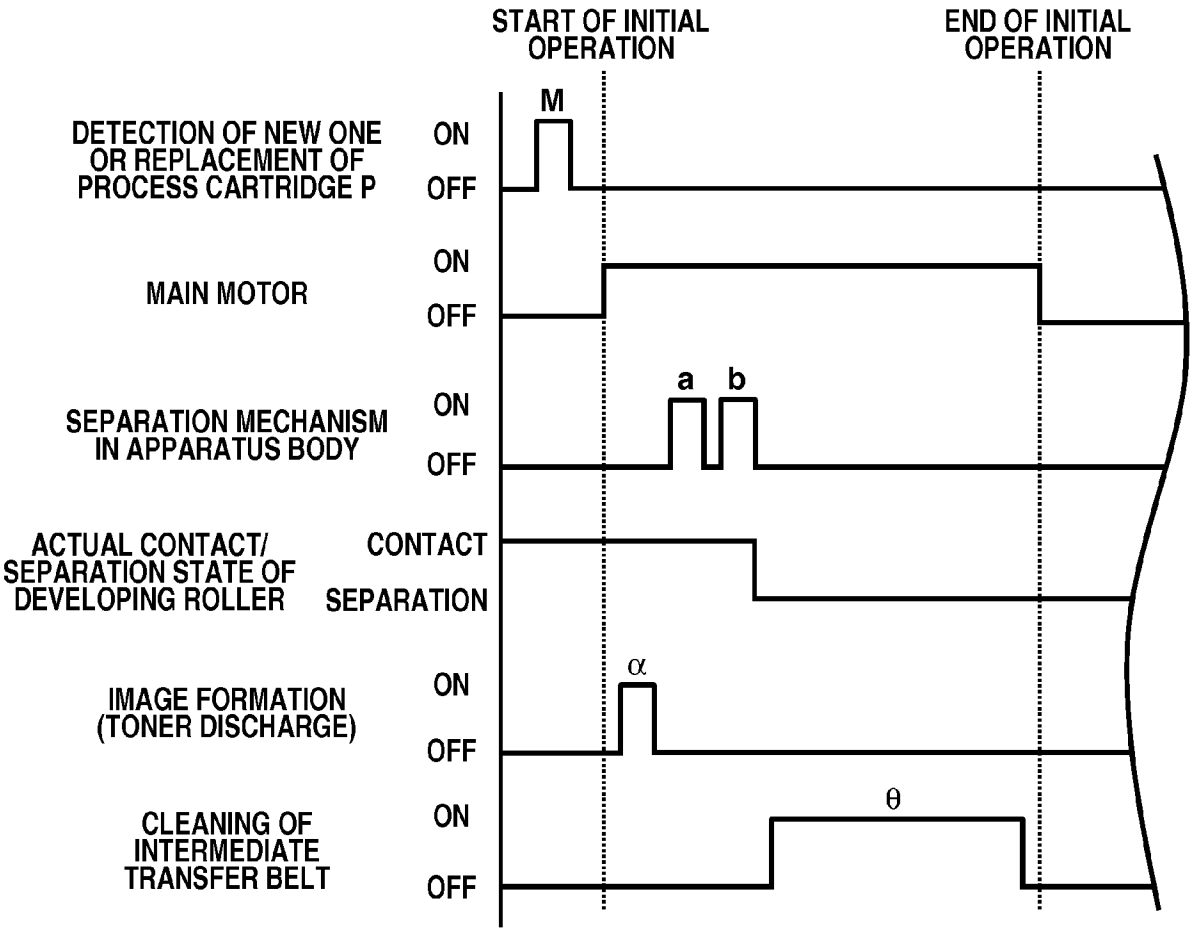
FIG. 14 is a timing chart according to the first exemplary embodiment.

FIG. 14 is a timing chart during the initial operation in the present exemplary embodiment. Referring to FIG. 14, first, the image forming apparatus 100 detects that the process cartridge P is a new one or the process cartridge P has been replaced (in a period M in FIG. 14). In the present exemplary embodiment, the process cartridge P is equipped with a memory tag (not illustrated), which is a memory unit that detects that the process cartridge has been replaced with a new one or detects the lifetime of toner or the photosensitive drum 1. The memory tag can store identification information, lifetime information, and image process information of the process cartridge P to enable constantly recognizing up-to-date information of the process cartridge P and performing optimum image formation.

On the other hand, the mounting portion in the image forming apparatus 100 is equipped with the reader 94, which is a reading unit that reads out information of the memory tag provided in the process cartridge P. When the process cartridge P has been mounted on the mounting portion in the image forming apparatus 100, the controller 91 acquires information from the memory tag of the process cartridge P via the reader 94, and detects that the process cartridge P is a new one or that the process cartridge P has been replaced. Thus, the reader 94 also serves as a cartridge detection unit that detects a use status of the process cartridge P (whether the process cartridge P is a new one).

Then, in the initial operation after performing the above-mentioned detection, the image forming apparatus 100 turns on the main moor 95 concurrently with the start of the initial operation to start operations of the photosensitive drum 1 and the intermediate transfer belt 13, and then starts operations of the laser scanner 11 and the various high-voltage power sources 97, 98, and 99. Then, at a point of time when the main motor 95 has reached a steady rotation, the image forming apparatus 100 performs an exposure operation as toner discharge in the process cartridge P (an operation by the laser scanner 11 to expose the photosensitive drum 1 with a laser beam) (in a period "a" in FIG. 14).

The toner discharge means an operation (supply operation) for feeding toner as lubricant from the developing unit 4 to the cleaning blade 51 via the photosensitive drum 1. In the supply operation, the photosensitive drum 1 is exposed by the laser scanner 11, toner is supplied from the developing roller 41 to the exposed portion (region) of the photosensitive drum 1, and the toner supplied to the photosensitive drum 1 reaches a contact portion between the photosensitive drum 1 and the cleaning blade 51, thus functioning as lubricant.

The cleaning blade 51 of the process cartridge P is made of polyurethane rubber, which is a type of thermoplastic elastomer, in terms of chemical resistance, abrasion resistance, moldability, and mechanical strength. However, since there is only a little amount of something functioning as lubricant, such as residual toner, particularly when the cartridge P is a new one, which the user begins to use, or the cartridge P is replaced, a large frictional force is generated between the edge of the cleaning blade 51 and the photosensitive drum 1, so that such a problem as turning-up or chatter vibration of the cleaning blade 51 is likely to occur.

Therefore, the image forming apparatus 100 according to the present exemplary embodiment performs toner discharge in the initial operation immediately after detecting the mounting of a new process cartridge P or the replacement of the process cartridge P based on information from the memory tag, to feed toner to the entire longitudinal region of the cleaning blade 51 via the photosensitive drum 1, thus reducing a friction between the photosensitive drum 1 and the cleaning blade 51 to prevent such a problem as turning-up or chatter vibration of the cleaning blade 51.

After the completion of the toner discharge operation (in a period "a" in FIG. 14), the image forming apparatus 100 causes the separation mechanism 60 to operate to actually separate the developing roller 41 from the photosensitive drum 1. More specifically, in the first operation (in a period "a" in FIG. 14), the moving member 62 of the separation mechanism 60 is moved to the second position. At this point of time, the position of the separation mechanism 60 of the image forming apparatus 100 coincides with the actual contact state of the developing roller 41 for the first time. In the second operation (in a period "b" in FIG. 14), the moving member 62 of the separation mechanism 60 is again moved to the first position. With this movement, the developing roller 41 becomes separated from the photosensitive drum 1 in all of the process cartridges P (PY, PM, PC, and PK).

In this state, the image forming apparatus 100 performs a belt cleaning operation (in a period "θ" in FIG. 14) to cause a cleaning unit (not illustrated) for the intermediate transfer belt 13 to collect residual toner on the intermediate transfer belt 13. Then, the image forming apparatus 100 turns off driving of the main motor 95 to end the initial operation.

As described above, the image forming apparatus 100 according to the present exemplary embodiment includes a mounting portion to and from which a process cartridge P including the photosensitive drum 1, the developing roller 41, and a cleaning member (the cleaning blade 51) is attachable and detachable. The image forming apparatus 100 further includes the separation mechanism 60. The separation mechanism 60 is able to take a first position (illustrated in FIG. 11C) to separate the developing roller 41 and the photosensitive drum 1 from each other and a second position (illustrated in FIG. 11B) to allow the developing roller 41 and the photosensitive drum 1 to contact each other.

The image forming apparatus 100 further includes an allowance mechanism (the retraction member 61 and the urging spring 63) that allows the process cartridge P to be mounted on the mounting portion in a contact state in which the developing roller 41 and the photosensitive drum 1 are in contact with each other when the separation mechanism 60 is in the first position. Thus, even when the separation mechanism 60 is originally in a position to separate the developing roller 41 and the photosensitive drum 1 from each other (the first position), the process cartridge P can be mounted with the developing roller 41 and the photosensitive drum 1 kept in contact with each other (illustrated in FIG. 11A).

In other words, if the process cartridge P is a new one (immediately after the process cartridge P is replaced), even when the separation mechanism 60 is in the first position, the developing roller 41 and the photosensitive drum 1 are in contact with each other.

Therefore, if it is determined by a cartridge detection unit (the reader 94) that the process cartridge P is a new one, the control unit (the controller 91) does not need to move the separation mechanism 60 from the first position. The image forming apparatus 100 can supply toner as lubricant from the photosensitive drum 1 to the developing roller 41 immediately in the initial operation without moving the separation mechanism 60 from the first position.

According to the present exemplary embodiment, in a case where the controller 91 has detected the mounting of a new process cartridge P or the replacement of the process cartridge P based on information acquired from the memory tag of the process cartridge P via the reader 94, the user necessarily performs the opening and closing operation of the opening and closing door 30 to detach and attach the process cartridge P. Therefore, the controller 91 can determine that the developing roller 41 is surely in contact with the photosensitive drum 1 in all of the first to fourth process cartridges P (PY, PM, PC, and PK). Accordingly, the image forming apparatus 100 can perform an exposure operation for discharging toner (lubricant) before causing the separation mechanism 60 of the image forming apparatus 100 to operate in the initial operation.

Since, in the initial operation, the timing to supply lubricant can be made earlier, the amount of time required for the entire initial operation is reduced, so that a period of time required for the image forming apparatus 100 to become ready for image formation is shortened.

Thus, the initial operation time can be shortened by reducing a surplus operating time of the separation mechanism 60 and a cleaning time of the intermediate transfer belt 13 associated with the operation of the separation mechanism 60. Furthermore, the timing to start a next printing operation can be made earlier.

Moreover, the shortening of the initial operation time results in the reduction of the rotation time of the main motor 95, so that the rotation time of the photosensitive drum 1 or the intermediate transfer belt 13 can be reduced to attain the long lifetime of the image forming apparatus 100.

The number of process cartridges P simultaneously attachable to the image forming apparatus 100 is not limited to the illustrated one, but may be suitably set as appropriate.

Furthermore, the image forming apparatus 100 is not limited to a color image forming apparatus, but may be a monochrome image forming apparatus.

Although toner is used as lubricant to be supplied in the initial operation, a material other than toner (for example, urethane particles) can be used as lubricant. The details of the lubricant is described below in a fifth exemplary embodiment.

A modification example 1 is characterized in that, when the controller 91 has detected the mounting of a new process cartridge P or the replacement of the process cartridge P as described above, the image forming apparatus 100, which has the same configuration as that in the first exemplary embodiment, performs a calibration operation before causing the separation mechanism 60 of the image forming apparatus 100 to operate. The calibration operation is an operation to adjust the color tint or the color misregistration of an output image. The configuration of a control unit of the image forming apparatus 100 in the modification example 1 is similar to that of the control unit illustrated in FIG. 13 described in the first exemplary embodiment.

Like the first exemplary embodiment, at a point of time when the image forming apparatus 100 has detected the mounting of a new process cartridge P or the replacement of the process cartridge P based on information acquired from the memory tag of the process cartridge P via the reader 94 (detection unit), the image forming apparatus 100 can determine that the developing roller 41 is surely in contact with the photosensitive drum 1 in all of the first to fourth process cartridges P (PY, PM, PC, and PK). Accordingly, in the immediate initial operation, the image forming apparatus 100 does not need to move the moving member 62 of the separation mechanism 60, and can perform an exposure operation for forming a calibration patch image immediately after the start of the initial operation and before causing the separation mechanism 60 of the image forming apparatus 100 to operate. Thus, the image forming apparatus 100 exposes the photosensitive drum 1 and supplies toner from the developing roller 41 to the exposed region of the photosensitive drum 1. Accordingly, the image forming apparatus 100 can perform an operation to form, on the photosensitive drum 1, a patch image used to adjust an output image. In other words, according to the modification example 1, instead of supplying toner as lubricant in the initial operation, the image forming apparatus 100 supplies, to the photosensitive drum 1, toner to form a detection toner image (patch image) for detecting the image density or the like.

Figure 15:
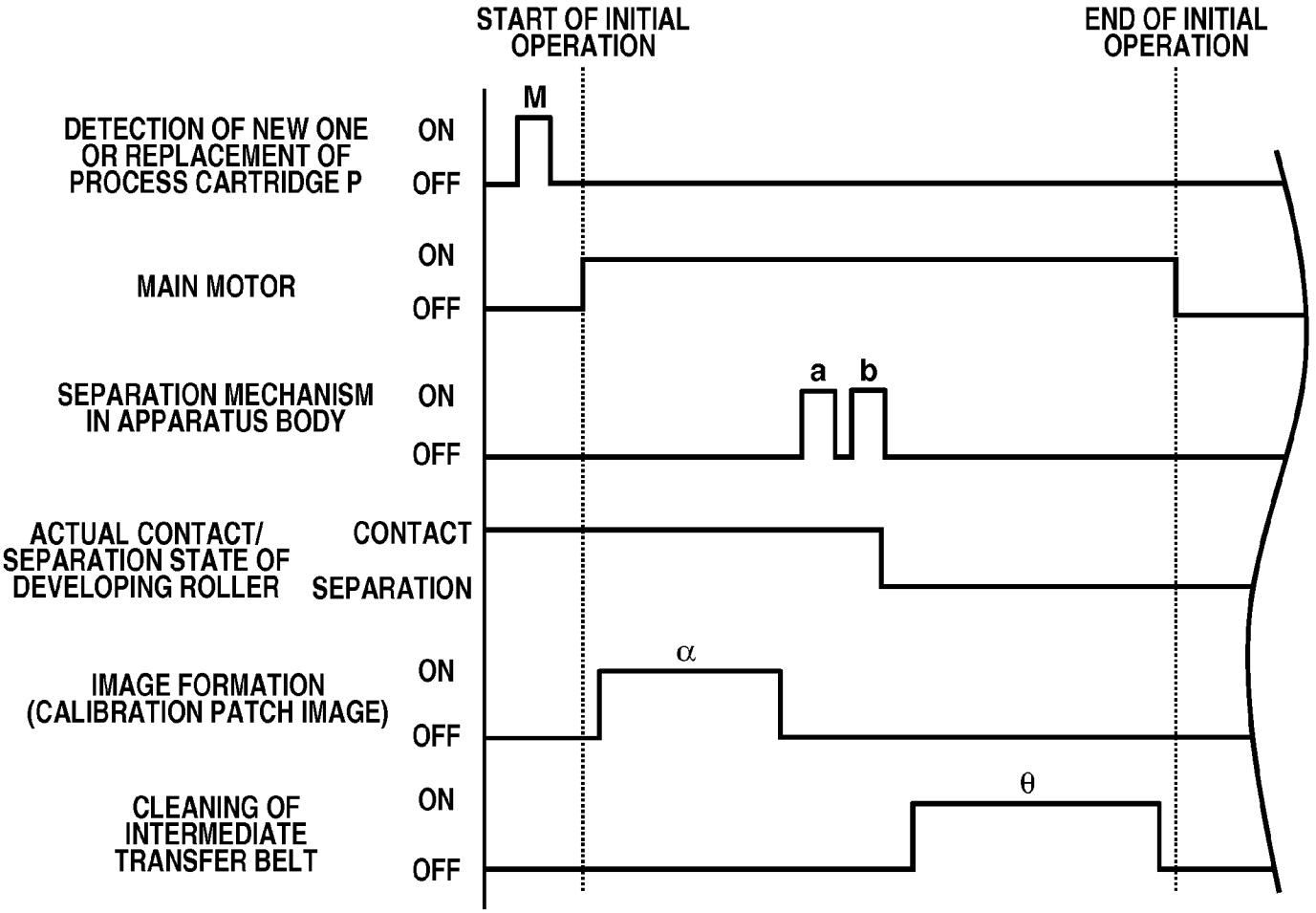
FIG. 15 is a timing chart according to a modification example of the first exemplary embodiment.

FIG. 15 is a timing chart during the initial operation in the modification example 1. Like the first exemplary embodiment, first, the image forming apparatus 100 detects that the process cartridge P is a new one or the process cartridge P has been replaced (in a period M in FIG. 15). In the modification example 1 also, like the first exemplary embodiment, when the process cartridge P has been mounted on the mounting portion in the image forming apparatus 100, the controller 91 acquires information from the memory tag of the process cartridge P via the reader 94, and detects that the process cartridge P is a new one or that the process cartridge P has been replaced.

Then, in the initial operation after performing the above-mentioned detection, the image forming apparatus 100 turns on the main moor 95 concurrently with the start of the initial operation to start operations of the photosensitive drum 1 and the intermediate transfer belt 13, and then starts operations of the laser scanner 11 and the various high-voltage power sources 97, 98, and 99. Then, at a point of time when the main motor 95 has reached a steady rotation, the image forming apparatus 100 performs an exposure operation as calibration patch image formation in the process cartridge P (in a period "α" in FIG. 15).

Calibration patch images formed on the photosensitive drums 1 are sequentially primarily transferred onto the intermediate transfer belt 13 for each color, and are rotationally conveyed according to the rotation of the belt driving roller 14. The conveyed calibration patch images are then detected by an optical sensor (not illustrated). The image forming apparatus 100 corrects the color tint or color misregistration of an output image based on a result of the detection.

The operation of the image forming apparatus 100 performed after the completion of detection of calibration patch images by the optical sensor is similar to that in the first exemplary embodiment, and, therefore, the detailed description thereof is not repeated.

As described above, according to the modification example 1, in a case where the controller 91 has detected the mounting of a new process cartridge P or the replacement of the process cartridge P based on information acquired from the memory tag of the process cartridge P via the reader 94, the user necessarily performs the opening and closing operation of the opening and closing door 30 to detach and attach the process cartridge P. Therefore, the controller 91 can determine that the developing roller 41 is surely in contact with the photosensitive drum 1 in all of the first to fourth process cartridges P (PY, PM, PC, and PK). Accordingly, the image forming apparatus 100 can perform an exposure operation as calibration patch image formation before causing the separation mechanism 60 of the image forming apparatus 100 to operate in the initial operation.

Thus, the initial operation time can be shortened by reducing a surplus operating time of the separation mechanism 60 and a cleaning time of the intermediate transfer belt 13 associated with the operation of the separation mechanism 60. Furthermore, the timing to start a next printing operation can be made earlier.

In the configuration of an image forming apparatus 100 according to a second exemplary embodiment, members similar to those in the first exemplary embodiment are denoted by the respective same reference numerals, and, therefore, the description thereof is not repeated.

Figure 16:
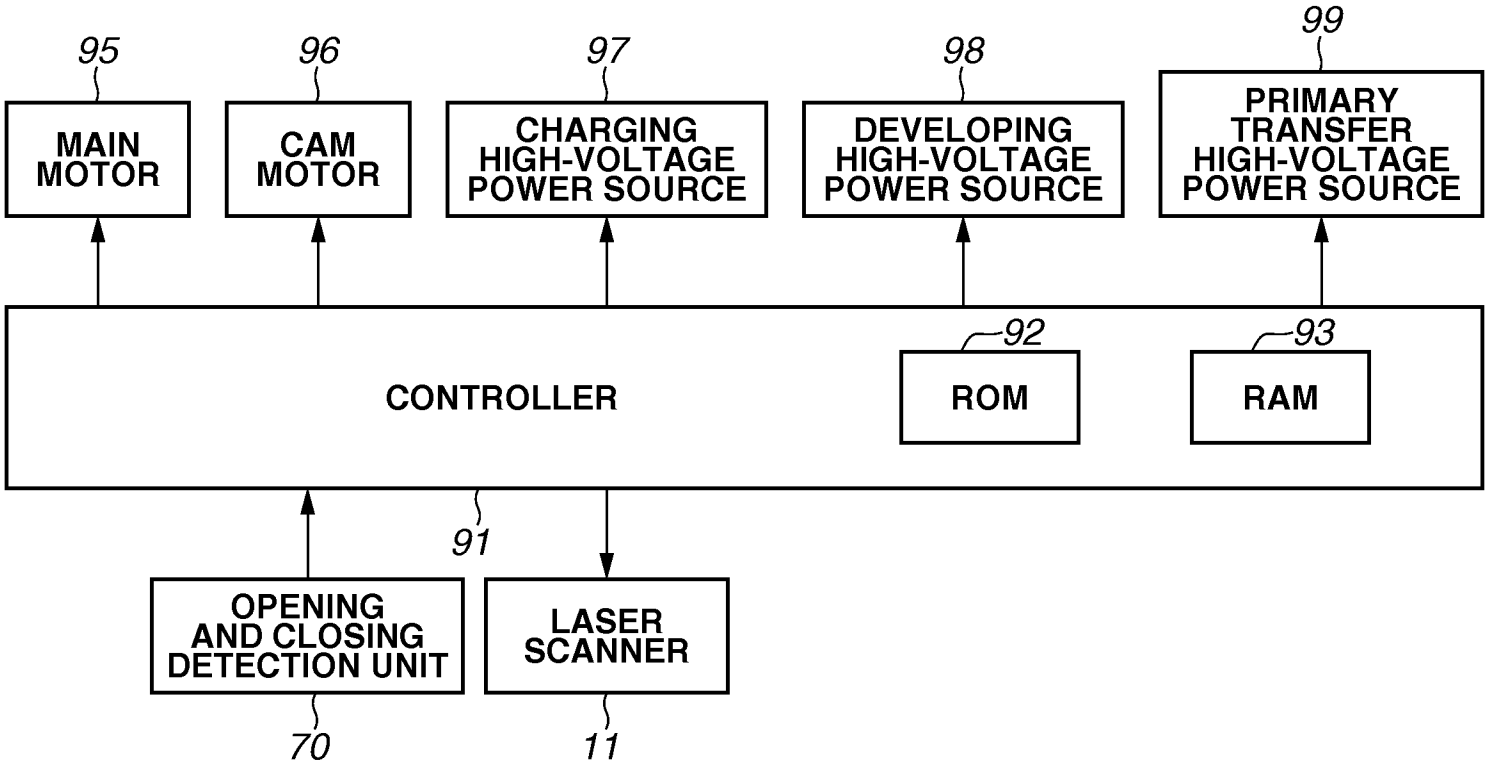
FIG. 16 is a block diagram illustrating a configuration of a control unit included in an image forming apparatus according to a second exemplary embodiment.

The image forming apparatus 100 according to the second exemplary embodiment is characterized in that the image forming apparatus 100 includes an opening and closing detection unit 70 that detects opening and closing of the opening and closing door 30, as illustrated in FIG. 16. FIG. 16 is a block diagram illustrating a configuration of a control unit of the image forming apparatus 100. The second exemplary embodiment differs from the first exemplary embodiment in that the opening and closing detection unit 70 is provided in place of the reader 94 (illustrated in FIG. 13). The controller 91 controls operations of the main motor 95, the cam motor 96, the laser scanner 11, and the various high-voltage power sources 97, 98, and 99 based on control programs stored in the ROM 92 and a detection signal output from the opening and closing detection unit 70.

Figure 17A:
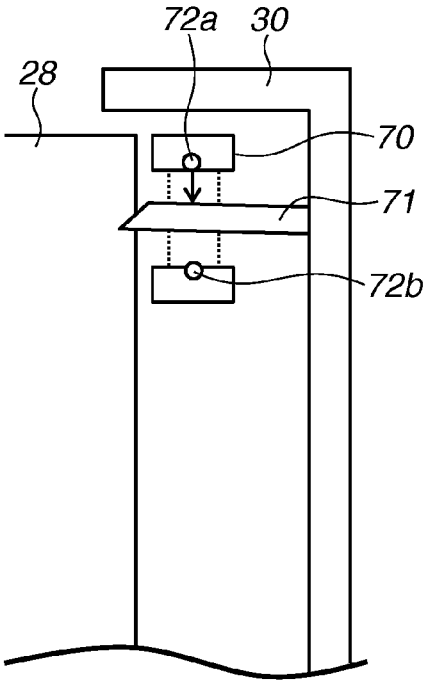
FIGS. 17A and 17B illustrate motions of an opening and closing detection unit and surrounding components according to the second exemplary embodiment.
Figure 17B:
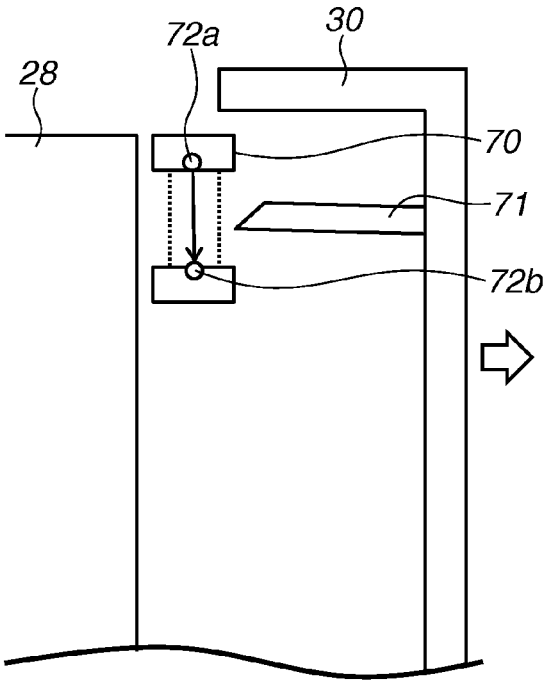

A specific configuration of the opening and closing detection unit 70 is described with reference to FIGS. 17A and 17B. FIGS. 17A and 17B are essential schematic views as viewed from above the image forming apparatus 100, illustrating motions of components around the opening and closing detection unit 70 provided in the opening and closing door 30 of the image forming apparatus 100. FIG. 17A illustrates attitudes of the components around the opening and closing detection unit 70 when the opening and closing door 30 is in the closed state. FIG. 17B illustrates attitudes of the components around the opening and closing detection unit 70 when the opening and closing door 30 is in the opened state.

As illustrated in FIG. 17A, when the opening and closing door 30 is in the closed state, a protruding portion 71 mounted on the opening and closing door 30 on the right side as viewed from the front is located in a position to block light exit and entrance portions of a light emitting element 72*a* and a light receiving element 72*b*, which constitute an optical sensor. Based on a detection signal output from the opening and closing detection unit 70 at this time, the controller 91 determines that the opening and closing door 30 is in the closed state.

On the other hand, when the opening and closing door 30 is opened, as illustrated in FIG. 17B, the protruding portion 71 mounted on the opening and closing door 30 is moved to a position to expose the light exit and entrance portions of the light emitting element 72*a* and the light receiving element 72*b*. Based on a detection signal output from the opening and closing detection unit 70 at this time, the controller 91 determines that the opening and closing door 30 is in the opened state.

Accordingly, in a case where the opening and closing detection unit 70 has detected that the user has opened the opening and closing door 30, like the first exemplary embodiment, the image forming apparatus 100 can determine that the developing roller 41 is surely in contact with the photosensitive drum 1 in all of the first to fourth process cartridges P (PY, PM, PC, and PK).

Thus, while, in the first exemplary embodiment, the reader (reading unit) 94 provided in the image forming apparatus 100 detects that the opening and closing door 30 has been opened, in the second exemplary embodiment, the opening and closing detection unit 70 directly detects that the opening and closing door 30 has been opened. The initial operation performed after that detection is controlled in the same manner as in the first exemplary embodiment. Therefore, the detailed description of the control of the initial operation is not repeated.

As described above, according to the second exemplary embodiment, in a case where the opening and closing detection unit 70 has detected that the opening and closing door 30 has been opened, the image forming apparatus 100 can determine that the developing roller 41 is surely in contact with the photosensitive drum 1 in all of the first to fourth process cartridges P (PY, PM, PC, and PK). Accordingly, the image forming apparatus 100 can perform an exposure operation as toner discharge before causing the separation mechanism 60 of the image forming apparatus 100 to operate in the initial operation (with the separation mechanism 60 kept in the first position).

Thus, the initial operation time can be shortened by reducing a surplus operating time of the separation mechanism 60 and a cleaning time of the intermediate transfer belt 13 associated with the operation of the separation mechanism 60. Furthermore, the timing to start a next printing operation can be made earlier.

Moreover, the shortening of the initial operation time results in the reduction of the rotation time of the main motor 95, so that the rotation time of the photosensitive drum 1 or the intermediate transfer belt 13 can be reduced to attain the long lifetime of the image forming apparatus 100.

The number of process cartridges P simultaneously attachable to the image forming apparatus 100 is not limited to the illustrated one, but may be suitably set as appropriate.

Furthermore, the image forming apparatus 100 is not limited to a color image forming apparatus, but may be a monochrome image forming apparatus.

Furthermore, the second exemplary embodiment can be applied to a case where the image forming apparatus 100 performs a calibration operation before causing the separation mechanism 60 of the image forming apparatus 100 to operate in the initial operation, as in the modification example 1 of the first exemplary embodiment. More specifically, when the opening and closing detection unit 70 has detected that the opening and closing door 30 has been opened, the image forming apparatus 100 having the same configuration as in the second exemplary embodiment can determine that the developing roller 41 is surely in contact with the photosensitive drum 1 in all of the first to fourth process cartridges P (PY, PM, PC, and PK). Accordingly, the image forming apparatus 100 can perform a calibration patch image forming operation before causing the separation mechanism 60 of the image forming apparatus 100 to operate in the initial operation.

A modification example 2 is characterized in that the image forming apparatus 100 has a configuration obtained by combining the configurations of the first and second exemplary embodiments and, in a case where the opening and closing detection unit 70 has detected that the opening and closing door 30 has been opened and the controller 91 has determined, based on information from the reader 94, that the process cartridge P has not been replaced, the image forming apparatus 100 performs, according to a print signal received by the image forming apparatus 100, an exposure operation as an image forming operation before causing the separation mechanism 60 of the image forming apparatus 100 to operate, without performing the initial operation.

Figure 18:
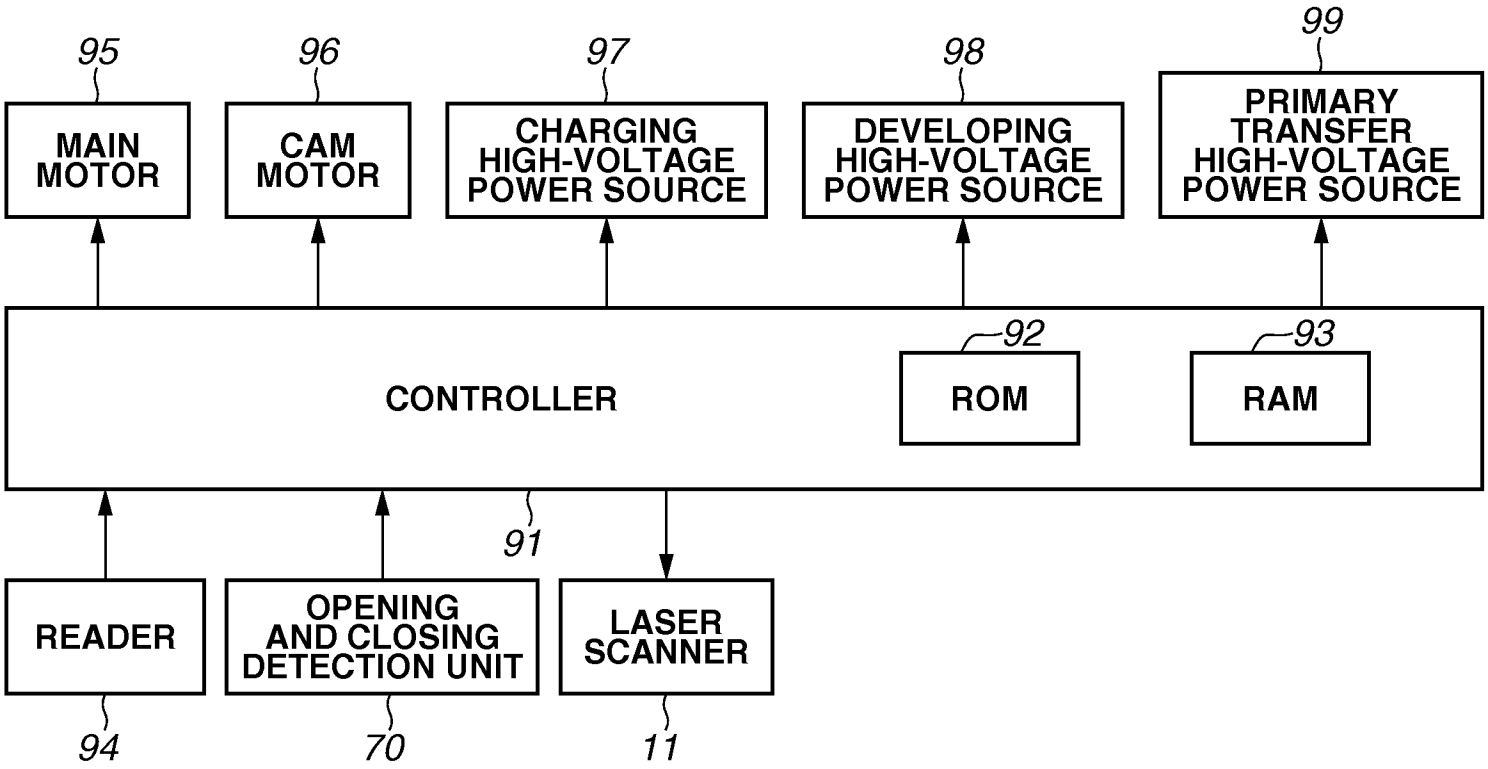
FIG. 18 is a block diagram illustrating a configuration of a control unit included in an image forming apparatus according to a modification example of the second exemplary embodiment.

FIG. 18 is a block diagram illustrating a configuration of a control unit including both the reader 94 and the opening and closing detection unit 70. The description of each component illustrated in FIG. 18 is the same as in the first and second exemplary embodiments, and is, therefore, omitted here.

In the modification example 2 also, at a point of time when the opening and closing detection unit 70 has detected that the opening and closing door 30 has been opened, the image forming apparatus 100 can determine that the developing roller 41 is surely in contact with the photosensitive drum 1 in all of the first to fourth process cartridges P (PY, PM, PC, and PK). In addition, since the process cartridge P has not been replaced, the image forming apparatus 100 does not need to perform toner discharge or a calibration operation. Accordingly, in a case where the image forming apparatus 100 has immediately received a print signal, the image forming apparatus 100 can shift to an exposure operation as an image forming operation without performing the initial operation.

Figure 19:
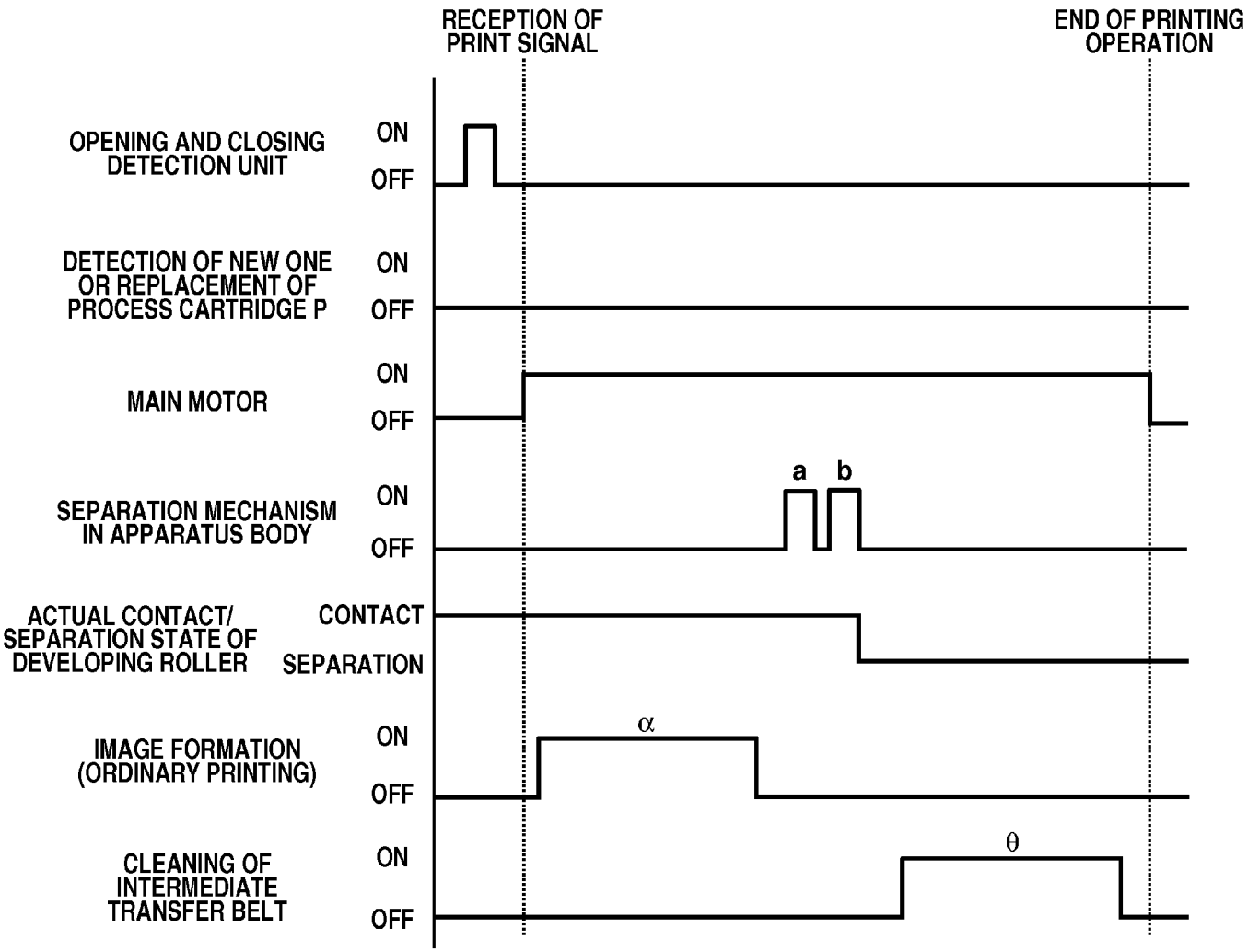
FIG. 19 is a timing chart according to the modification example of the second exemplary embodiment.

FIG. 19 is a timing chart illustrating the operation according to the modification example 2. As illustrated in FIG. 19, in a case where the opening and closing detection unit 70 has detected that the opening and closing door 30 has been opened and the controller 91 has determined, based on information from the reader 94, that the process cartridge P has not been replaced, the image forming apparatus 100 performs, according to a print signal received by the image forming apparatus 100, an image forming operation without performing the initial operation. More specifically, the image forming apparatus 100 turns on the main motor 95 concurrently with reception of a print signal to start operations of the photosensitive drum 1 and the intermediate transfer belt 13, and then starts operations of the laser scanner 11 and the various high-voltage power sources 97, 98, and 99. Then, at a point of time when the main motor 95 has reached a steady rotation, the image forming apparatus 100 performs an image forming exposure operation based on the print signal in the process cartridge P (in a period "α" in FIG. 19).

After the completion of the image forming operation (in a period "α" in FIG. 19), the image forming apparatus 100 causes the separation mechanism 60 to operate to actually separate the developing roller 41 from the photosensitive drum 1. More specifically, in the first operation (in a period "a" in FIG. 19), the moving member 62 of the separation mechanism 60 is moved to the second position. At this point of time, the position of the separation mechanism 60 of the image forming apparatus 100 coincides with the actual contact state of the developing roller 41 for the first time. In the second operation (in a period "b" in FIG. 19), the moving member 62 of the separation mechanism 60 is again moved to the first position. With this movement, the developing roller 41 becomes separated from the photosensitive drum 1 in all of the process cartridges P (PY, PM, PC, and PK).

After that, in a post-rotation operation after image formation, the image forming apparatus 100 performs a belt cleaning operation (in a period "θ" in FIG. 14) to cause a cleaning unit (not illustrated) for the intermediate transfer belt 13 to collect residual toner on the intermediate transfer belt 13. Then, the image forming apparatus 100 turns off driving of the main motor 95 to end the entire printing operation.

As described above, according to the modification example 2, in a case where the opening and closing detection unit 70, which is mounted in the image forming apparatus 100, has detected that the opening and closing door 30 has been opened and the controller 91 has determined, based on information from the reader 94, that the process cartridge P has not been replaced, the image forming apparatus 100 performs, according to a print signal received by the image forming apparatus 100, an exposure operation as an image forming operation before causing the separation mechanism 60 of the image forming apparatus 100 to operate, without performing the immediate initial operation.

Thus, the timing to start an immediate printing operation can be made earlier by reducing a surplus operating time of the separation mechanism 60 and a cleaning time of the intermediate transfer belt 13 associated with the operation of the separation mechanism 60.

In the configuration of an image forming apparatus 100 according to a third exemplary embodiment, members similar to those in the first and second exemplary embodiments are denoted by the respective same reference numerals, and, therefore, the description thereof is not repeated.

The image forming apparatus 100 according to the third exemplary embodiment is characterized in that a retraction member (force receiving member) 61, which retracts from an engagement position to engage the cartridge P and the moving member 62 of the image forming apparatus 100 with each other to a retraction position when the process cartridge P is to be mounted in the image forming apparatus 100, is provided in the process cartridge P.

Figure 20A:
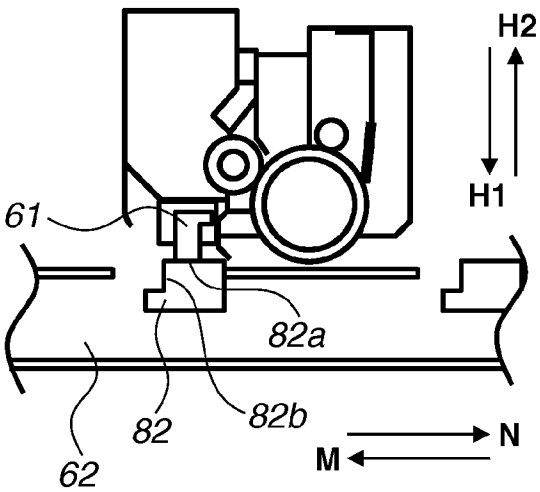
FIGS. 20A, 20B, and 20C illustrate the relationship between the process cartridge and a separation mechanism according to a third exemplary embodiment.
Figure 20B:
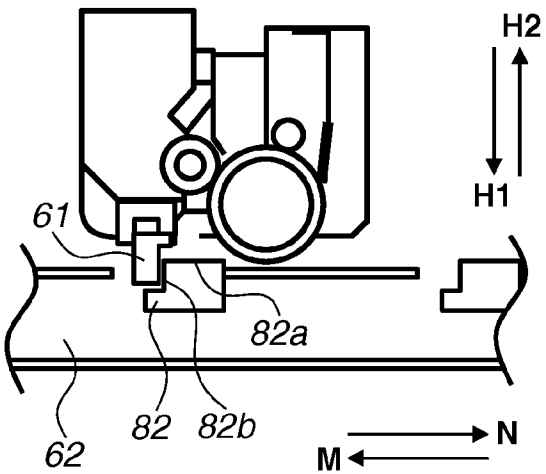
Figure 20C:
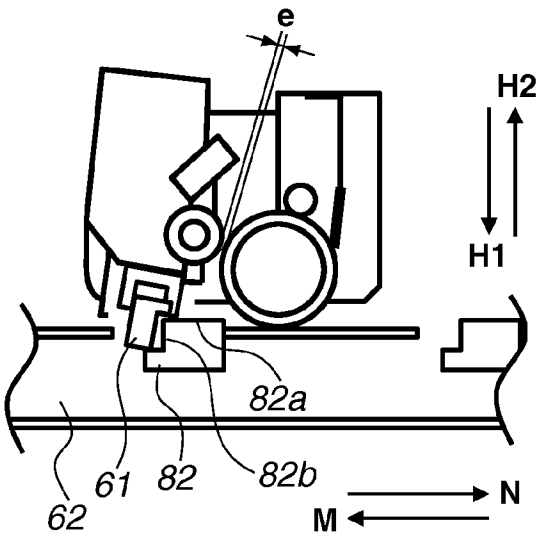

FIGS. 20A, 20B, and 20C illustrate states in which the process cartridge P is inserted into the image forming apparatus 100. FIGS. 20A and 20C illustrates states in which the separation mechanism 60 (moving member 62) is in the first position, and FIG. 20B illustrates a state in which the separation mechanism 60 (moving member 62) is in the second position.

The retraction member 61 is provided in the process cartridge P. The retraction member 61 is mounted to be movable in the directions of arrow H1 and arrow H2 illustrated in FIGS. 20A, 20B, and 20C by an urging spring (not illustrated). A force exerting member 82 is fixedly mounted on the moving member 62 of the image forming apparatus 100. The moving member 62 and the force exerting member 82 constitute a part of the separation mechanism 60.

When an operation to mount the process cartridge P is performed, the retraction member 61 is pressed by a protruding portion 82*a* of the force exerting member 82 in contact therewith to be moved approximately in parallel with the moving direction of the process cartridge P (the direction of arrow H2) while the urging spring (not illustrated) provided on the retraction member 61 is being compressed. In other words, the retraction member 61 is retracted (moved to the retraction position) by being pressed by the protruding portion 82*a* of the force exerting member 82, thus allowing the process cartridge P to move. Thus, the retraction member 61 is an allowance mechanism that allows the process cartridge P to be mounted with the photosensitive drum 1 and the developing roller 41 kept in contact with each other. This enables the process cartridge P to be mounted in a predetermined position within the image forming apparatus 100.

Next, an operation to engage a force exerting portion 82*b* of the force exerting member 82 and the retraction member 61 with each other is performed. To this end, the moving member 62 is temporarily moved to the right (in the direction of arrow N) in FIG. 20A up to a position (second position) to cause the retraction member 61 and the protruding portion 82*a* not to interfere with each other.

As illustrated in FIG. 20B, when the moving member 62 has been moved up to the second position to cause the retraction member 61 and the protruding portion 82*a* not to interfere with each other, the retraction member 61 moves downward (in the direction of arrow H1) due to the extension of the urging spring (not illustrated). This causes the retraction member 61 to shift to a position (engagement position) to allow engagement with the force exerting portion 82*b*.

Next, when the moving member 62 is moved to the left (in the direction of arrow M) in FIG. 20B, the retraction member 61 engages with the force exerting portion 82*b*. When the moving member 62 is further moved to the left (in the direction of arrow M) to return to the first position, the moving member 62 exerts a force on the retraction member 61 via the force exerting portion 82*b*. This causes the developing unit 4 to move up to a position (separation position) to separate the developing roller 41 from the photosensitive drum 1 with a clearance "e".

Thus, the image forming apparatus 100 according to the third exemplary embodiment has the same configuration as in the first and second exemplary embodiments except that the retraction member 61 is provided not on the moving member 62 (separation mechanism) of the image forming apparatus 100 but in the process cartridge P. Accordingly, the initial operation performed after the detection of replacement of the process cartridge P or the detection of opening and closing of the opening and closing door 30 is controlled in the same manner as in the above-described exemplary embodiments. Therefore, the detailed description of the initial operation is not repeated.

As described above, according to the third exemplary embodiment, in a case where the controller 91 has detected the mounting of a new process cartridge P or the replacement of the process cartridge P based on information acquired from the reader 94 or the opening and closing detection unit 70, which is mounted in the image forming apparatus 100, has detected that the opening and closing door 30 has been opened, the image forming apparatus 100 can determine that the developing roller 41 is surely in contact with the photosensitive drum 1 in all of the first to fourth process cartridges P (PY, PM, PC, and PK). Accordingly, the image forming apparatus 100 can perform an exposure operation as toner discharge or calibration patch image formation before causing the separation mechanism 60 of the image forming apparatus 100 to operate in the initial operation.

Thus, the initial operation time can be shortened by reducing a surplus operating time of the separation mechanism 60 and a cleaning time of the intermediate transfer belt 13 associated with the operation of the separation mechanism 60. Furthermore, the timing to start a next printing operation can be made earlier. Moreover, since the retraction member 61 is provided not on the separation mechanism 60 but in the process cartridge P, the configuration of the image forming apparatus 100 can be simplified.

Moreover, the shortening of the initial operation time results in the reduction of the rotation time of the main motor 95, so that the rotation time of the photosensitive drum 1 or the intermediate transfer belt 13 can be reduced to attain the long lifetime of the image forming apparatus 100.

In the configuration of an image forming apparatus 100 according to a fourth exemplary embodiment, members similar to those in the first to third exemplary embodiments are denoted by the respective same reference numerals, and, therefore, the description thereof is not repeated.

The image forming apparatus 100 according to the fourth exemplary embodiment is characterized in that the separation mechanism 60 of the image forming apparatus 100 is divided into a member for the first to third process cartridges P (PY, PM, and PC) and a member for the fourth process cartridge P (PK).

Next, the behavior of the retraction member 61 when the process cartridges P are mounted in the image forming apparatus 100 and the operation of the separation mechanism 60 separating the developing roller 41 and the photosensitive drum 1 from each other are specifically described.

Figure 21:
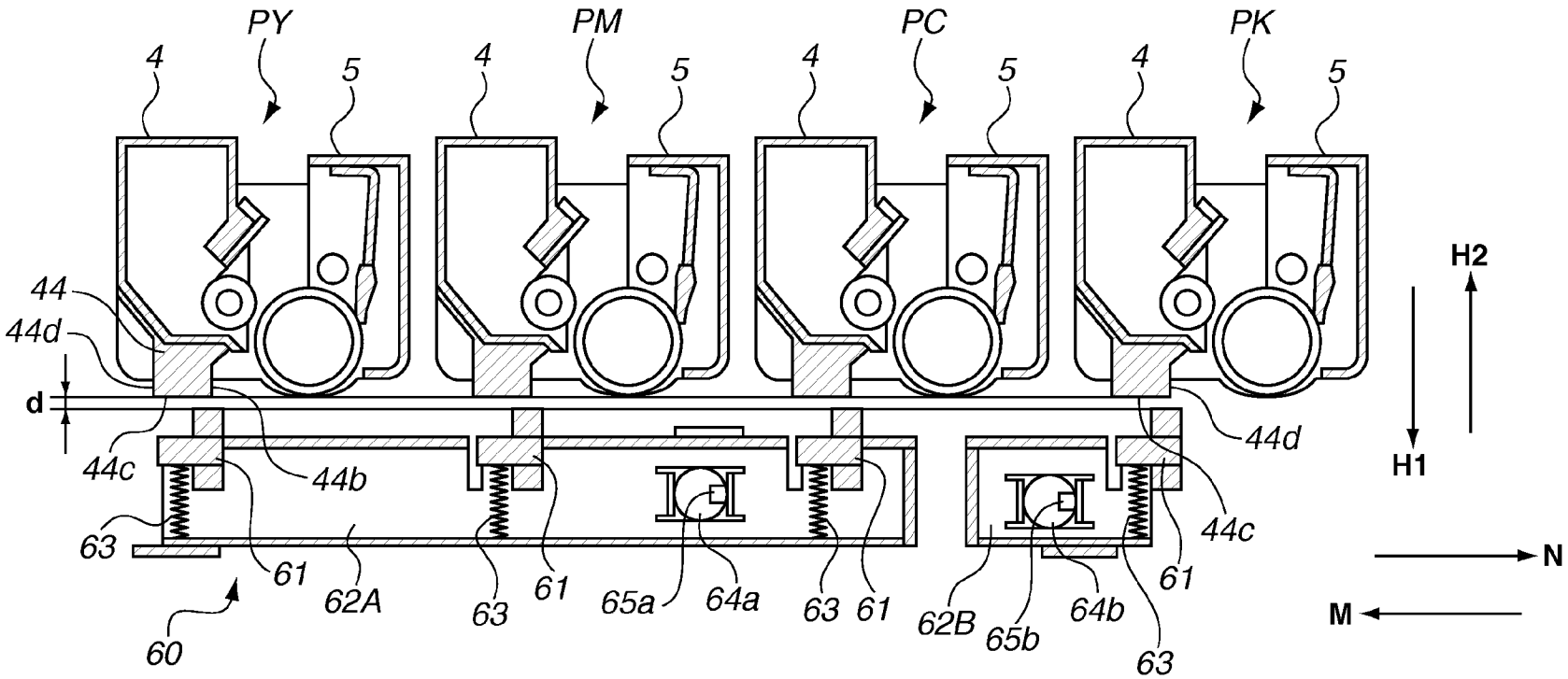
FIG. 21 is a sectional view illustrating a mounting state of the process cartridge according to a fourth exemplary embodiment.

FIG. 21 illustrates the process cartridges P and the separation mechanism 60 when the cartridge tray 28 and the process cartridges P are mounted in the image forming apparatus 100. The fourth exemplary embodiment differs from the first to third exemplary embodiments in that the moving member 62 is divided into a moving member 62A for PY, PM, and PC and a moving member 62B for PK, which are respectively provided with circular cams 64*a* and 64*b* and cam drive shafts 65*a* and 65*b*. The basic functions of the moving member 62 are similar to those in the first exemplary embodiment illustrated in FIGS. 11A, 11B, and 11C, and, therefore, the detailed description thereof is not repeated.

Like the first exemplary embodiment, when the opening and closing door 30 is in the opened state, the cartridge tray 28 has moved upward (in the direction of arrow H2). At this time, a clearance "d" is present between the retraction member 61 and the protruding portion 44*d* of the bearing member 44. Accordingly, even if, in this state, the cartridge tray 28 and the process cartridges P are moved in the horizontal directions (the directions of arrow M and arrow N), the retraction member 61 does not interfere with the bearing members 44.

Figure 22A:
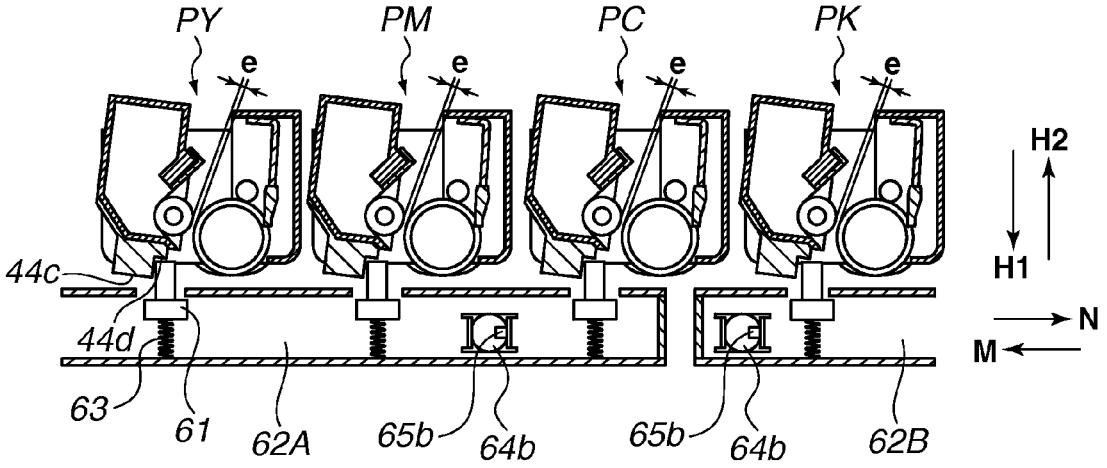
FIGS. 22A, 22B, and 22C are sectional views illustrating the relationship between the process cartridge and a separation mechanism according to the fourth exemplary embodiment.
Figure 22B:
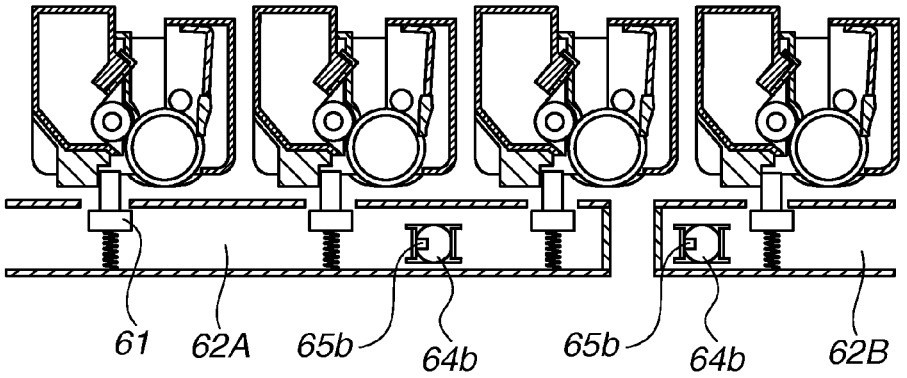
Figure 22C:
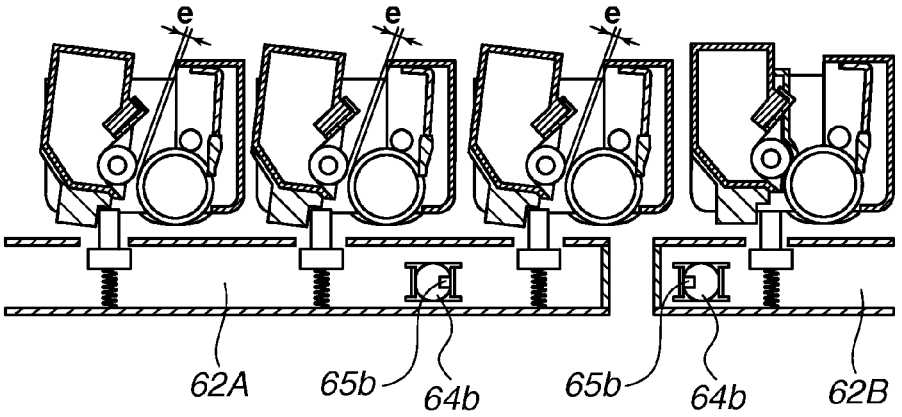

Furthermore, the separation mechanism 60 according to the fourth exemplary embodiment can take three contact/separation states as illustrated in FIGS. 22A, 22B, and 22C, including a "standby state" in which the developing roller 41 is separated from the photosensitive drum 1 in all of the image forming units (illustrated in FIG. 22A), a "full-color image forming state" in which the developing roller 41 is in contact with the photosensitive drum 1 in all of the image forming units (illustrated in FIG. 22B), and a "mono-color image forming state" in which the developing roller 41 is in contact with the photosensitive drum 1 in only the black image forming unit (illustrated in FIG. 22C). In addition, according to the operation of the separation mechanism 60, the contact/separation states change over in order, such as "standby state"→"full-color image forming state"→"mono-color image forming state"→"standby state"→ . . . .

A specific operation of the separation mechanism 60 is next described. In the fourth exemplary embodiment, when image formation is not being performed, the contact/separation state is kept to the "standby state", and both the moving member 62A and the moving member 62B are located in the first position. When, in this state, the separation mechanism 60 is caused to operate, both the moving member 62A and the moving member 62B are moved to the second position (in the direction of arrow N in FIG. 22A), so that the contact/separation state shifts to the "full-color image forming state" (illustrated in FIG. 22B). When, in this state, the separation mechanism 60 is caused to further operate, only the moving member 62A is moved to the first position (in the direction of arrow M in FIG. 22A), so that the contact/separation state shifts to the "mono-color image forming state" (illustrated in FIG. 22C). Then, when, in this state, the separation mechanism 60 is caused to further operate, only the moving member 62B is moved to the first position (in the direction of arrow M in FIG. 22A), so that the contact/separation state returns to the "standby state" (illustrated in FIG. 22A).

Accordingly, the image forming apparatus 100 performs an image forming operation according to the received print mode in such a manner as to set the contact/separation state to the "full-color image forming state" by causing the separation mechanism 60 to operate once in the case of full-color mode and to set the contact/separation state to the "mono-color image forming state" by causing the separation mechanism 60 to operate twice in the case of mono-color mode.

The initial operation and the printing operation in the image forming apparatus 100 are similar to those in the first to third exemplary embodiments and the modification examples 1 and 2, which can be applied to the image forming apparatus 100 in any combination. Therefore, the specific operation is omitted from the description here. In addition, the operation of the separation mechanism 60, which is performed after an exposure operation as toner discharge or an exposure operation as calibration patch image formation, is performed twice as in the above-described exemplary embodiments and modification examples. In the present exemplary embodiment, the contact/separation state is set to the "full-color image forming state" by causing the separation mechanism 60 to operate once, and the contact/separation state is set to the "mono-color image forming state" by causing the separation mechanism 60 to operate twice.

As described above, according to the fourth exemplary embodiment, the separation mechanism 60 of the image forming apparatus 100 is divided into a member for the first to third process cartridges P (PY, PM, and PC) and a member for the fourth process cartridge P (PK) and can take a plurality of contact/separation states. With the thus-configured separation mechanism 60, in a case where the controller 91 has detected the mounting of a new process cartridge P or the replacement of the process cartridge P based on information acquired from the reader 94 or the opening and closing detection unit 70, which is mounted in the image forming apparatus 100, has detected that the opening and closing door 30 has been opened, the image forming apparatus 100 can determine that the developing roller 41 is surely in contact with the photosensitive drum 1 in all of the first to fourth process cartridges P (PY, PM, PC, and PK). Accordingly, the image forming apparatus 100 can perform an exposure operation as toner discharge or calibration patch image formation before causing the separation mechanism 60 of the image forming apparatus 100 to operate in the initial operation.

Thus, the initial operation time can be shortened by reducing a surplus operating time of the separation mechanism 60 and a cleaning time of the intermediate transfer belt 13 associated with the operation of the separation mechanism 60. Furthermore, the timing to start a next printing operation can be made earlier.

Moreover, the shortening of the initial operation time results in the reduction of the rotation time of the main motor 95, so that the rotation time of the photosensitive drum 1 or the intermediate transfer belt 13 can be reduced to attain the long lifetime of the image forming apparatus 100.

While, in the fourth exemplary embodiment, the separation mechanism 60 is divided into a member for the first to third process cartridges P (PY, PM, and PC) and a member for the fourth process cartridge P (PK), this is not a restrictive one. The divided manner of the separation mechanism 60 can be arbitrarily set as appropriate.

In the configuration of an image forming apparatus 100 according to a fifth exemplary embodiment, members similar to those in the first to fourth exemplary embodiments are denoted by the respective same reference numerals, and, therefore, the description thereof is not repeated.

In the image forming apparatus 100 according to the fifth exemplary embodiment, the surface of the developing roller 41 in a process cartridge P that is a new one (in an unused state) is coated with urethane particles having positive polarity, which is opposite to normal polarity of toner, as an initial coating agent. The normal polarity of toner (developer) is a polarity with which toner is charged when used to develop a latent image (electrostatic latent image) formed on the photosensitive drum 1. In the fifth exemplary embodiment, the normal polarity of toner is negative polarity (minus polarity). The toner as developer is stored in the toner storage portion 43 (FIG. 9) within the developing unit 4.

The urethane particles, which are 5 to 7 μm in average particle diameter, function as lubricant to inhibit an increase in torque of the developing roller 41 due to the friction against the developing blade 42 during the rotation of the developing roller 41 in the initial operation. On the other hand, as the urethane particles are fed to the entire longitudinal region of the cleaning blade 51, where the photosensitive drum 1 and the cleaning blade 51 are in contact with each other, the urethane particles also function as lubricant to reduce the friction between the photosensitive drum 1 and the cleaning blade 51. Thus, the urethane particles serve two functions of inhibiting an increase in torque of the developing roller 41 in the initial operation and of preventing turning-up or chatter vibration of the cleaning blade 51.

Next, the initial operation performed when a new process cartridge P has been mounted in the image forming apparatus 100 is specifically described. The configuration of a control unit of the image forming apparatus 100 according to the fifth exemplary embodiment may be any one of the configurations described with reference to FIGS. 13, 16, and 18, and, therefore, the detailed description thereof is not repeated.

Figure 23:
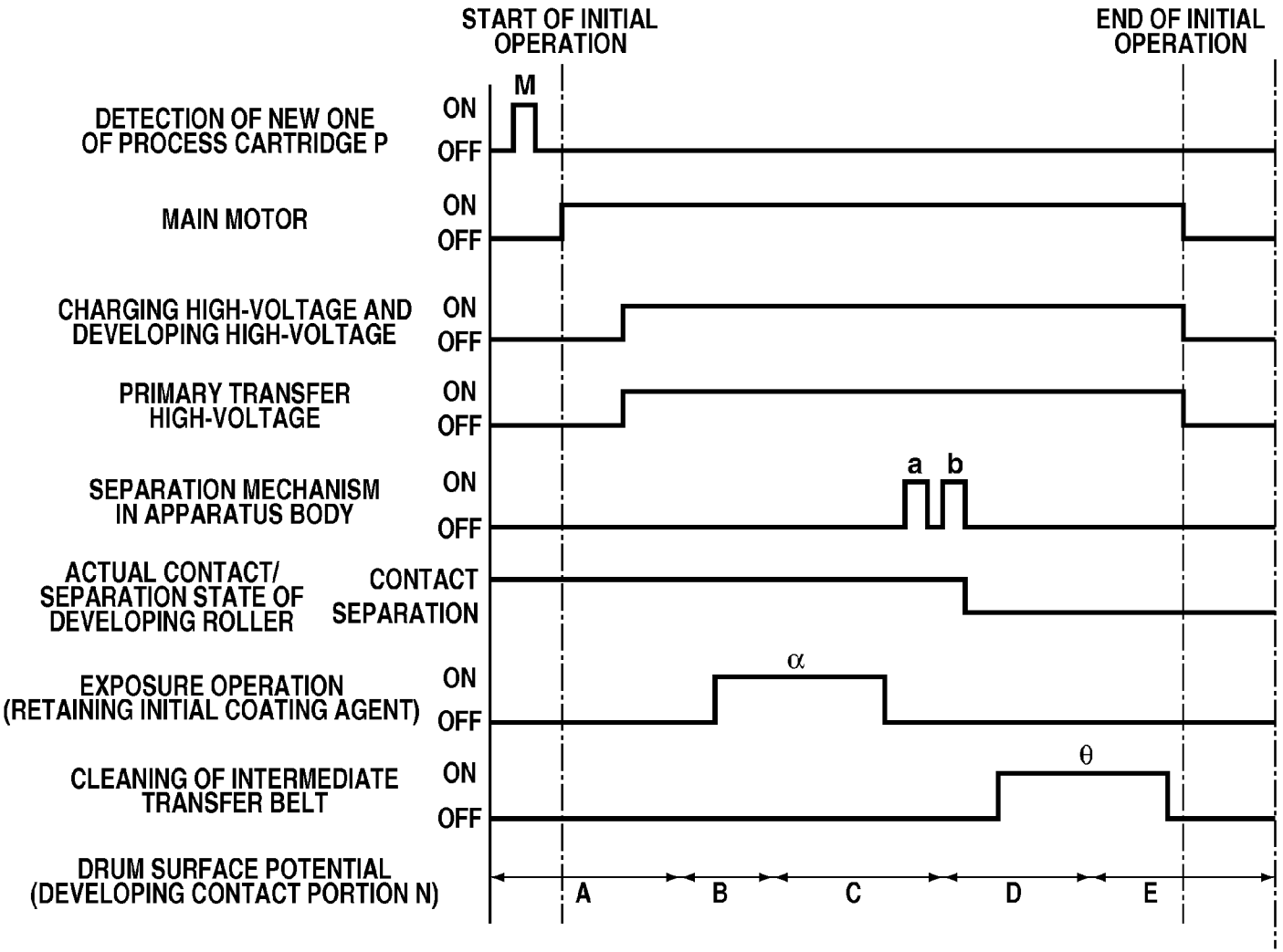
FIG. 23 is a timing chart of an image forming apparatus according to a fifth exemplary embodiment.

FIG. 23 is a timing chart during the initial operation performed when the reader 94 provided in the image forming apparatus 100 reads information stored in the memory tag of the process cartridge P and, based on the read information, the controller 91 has detected that the process cartridge P has been replaced with a new one. Referring to FIG. 23, first, the controller 91 detects that the process cartridge P is a new one based on information acquired from the reader 94 (in a period M in FIG. 23).

Then, in the immediate initial operation, the image forming apparatus 100 turns on the main moor 95 concurrently with the start of the initial operation to start operations of the photosensitive drum 1 and the intermediate transfer belt 13. This causes the photosensitive drum 1 to rotate in the direction of arrow K illustrated in FIG. 24.

Then, at a point of time when the main motor 95 has reached a steady rotation, the image forming apparatus 100 turns on the charging high-voltage power source 77, which supplies a bias voltage to the charging roller 3, the developing high-voltage power source 78, which supplies a bias voltage to the developing roller 41, and the primary transfer high-voltage power source 79, which supplies a bias voltage to the primary transfer roller 17. In the present exemplary embodiment, the charging applied voltage is −1000 V, and the developing applied voltage is −350 V. The surface potential of the photosensitive drum 1 in the stopped state (standby state) is almost 0 V although being different depending on an immediately preceding operation history of the image forming apparatus 100.

Figure 24:
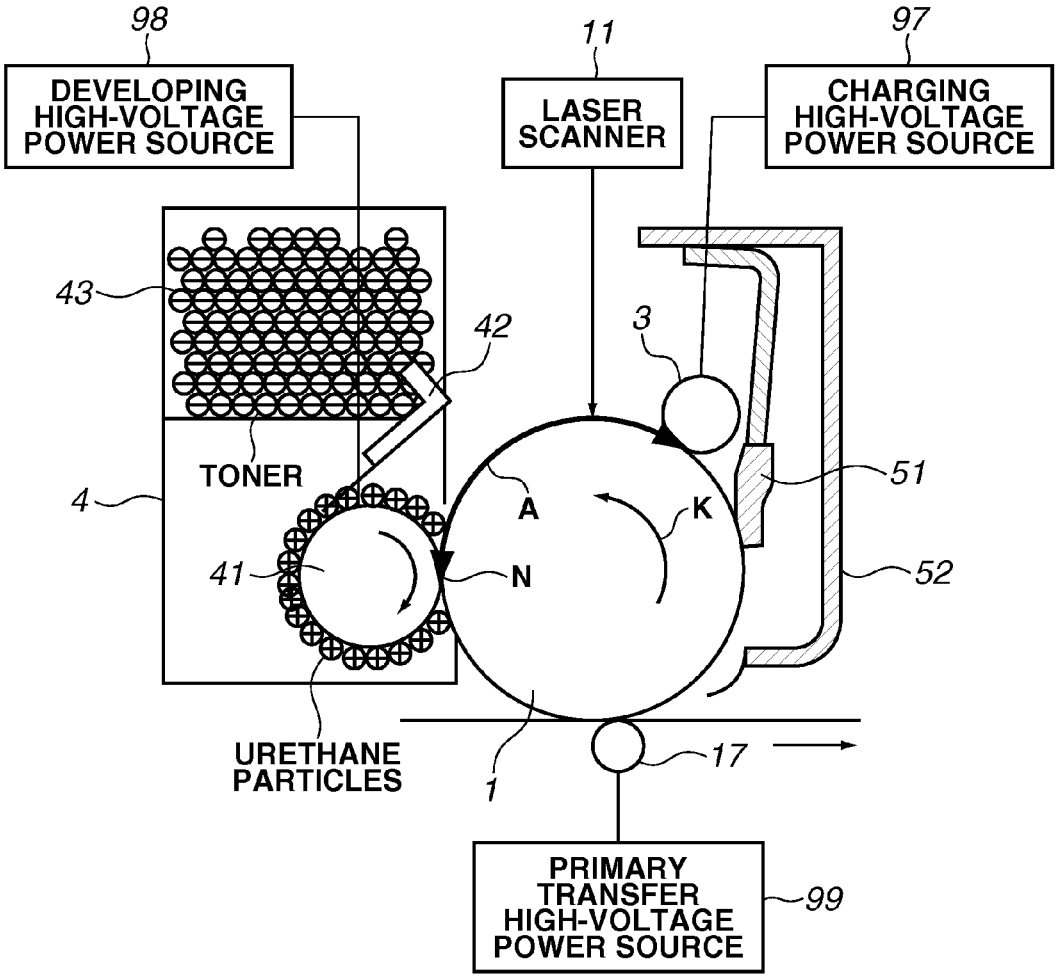
FIG. 24 is a sectional view illustrating a process cartridge according to the fifth exemplary embodiment.
Figure 25:
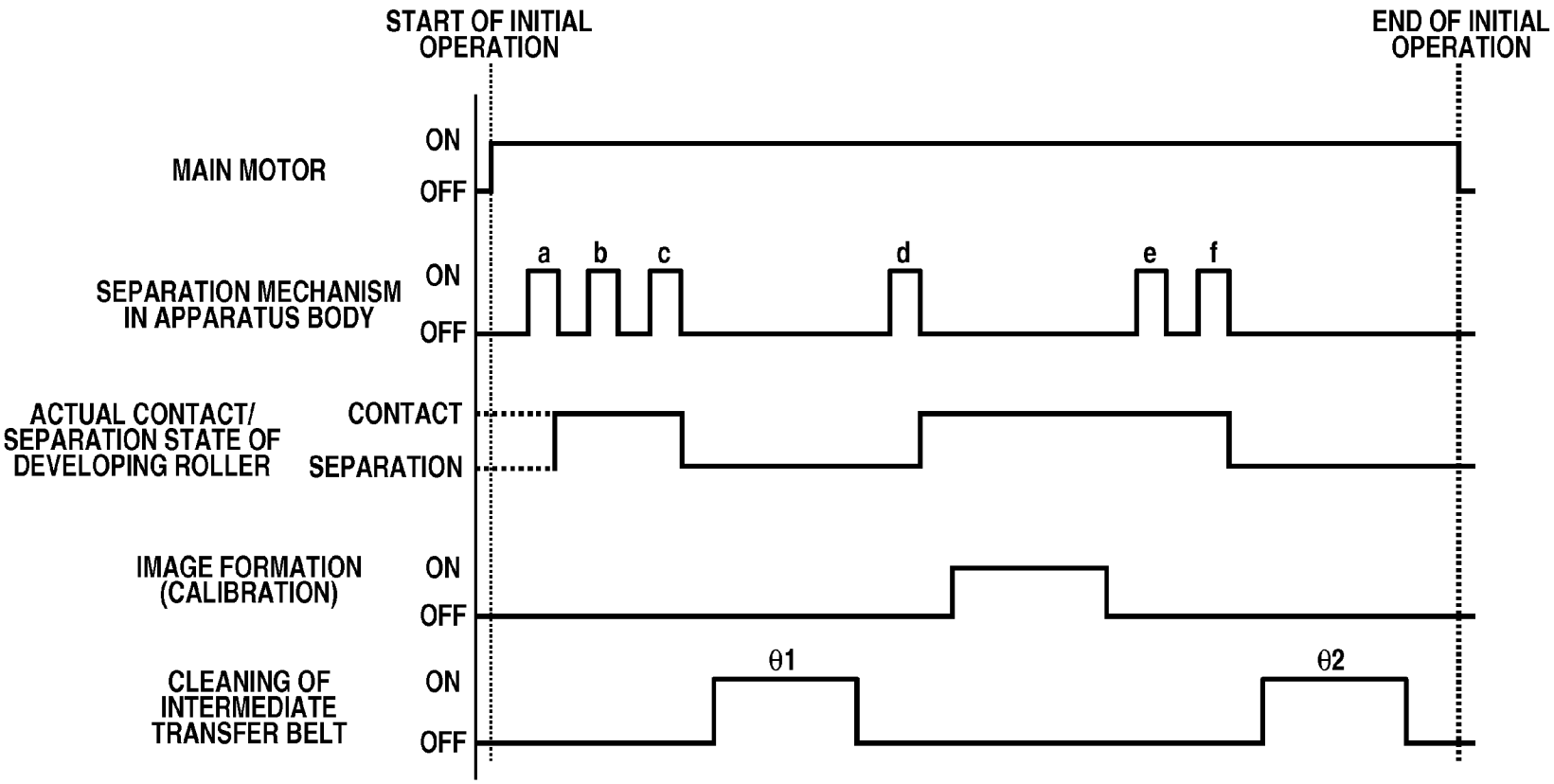
FIG. 25 is a timing chart of a conventional image forming apparatus.

The initial operation is started and the charging operation of the charging roller 3 for charging the photosensitive drum 1 is performed, so that the photosensitive drum 1 is almost uniformly charged at −500 V. During a period until the charged region (charging applied portion) of the photosensitive drum 1 reaches a contact portion (developing contact portion) between the photosensitive drum 1 and the developing roller 41 according to the rotation of the photosensitive drum 1 (during an interval A in FIG. 24), the potential of the photosensitive drum 1 at the developing contact portion N is almost 0 V, which is the same as at the start of the initial operation. The interval A illustrated in FIG. 24 is expressed as a period A in terms of time in FIG. 23. During the period A, urethane particles having positive polarity with which the developing roller 41 is coated are retained on the developing roller 41 owing to the potential relationship between the surface potential (−350 V) of the developing roller 41 and the surface potential (0 V) of the photosensitive drum 1. This is because an electric field that prevents urethane particles from transferring to the photosensitive drum 1 to retain urethane particles on the developing roller 41 is formed between the photosensitive drum 1 and the developing roller 41. Thus, there is formed an electric field that exerts, on urethane particles, a force directed from the photosensitive drum 1 to the developing roller 41.

Subsequently, starting with a point of time when the charging applied portion has reached the developing contact portion, urethane particles having positive polarity transfer to the photosensitive drum 1 owing to the potential relationship between the surface potential (−350 V) of the developing roller 41 and the surface potential (−500 V) of the photosensitive drum 1 (in a period B in FIG. 23). More specifically, owing to an electric field formed between the charging applied portion of the photosensitive drum 1 and the developing roller 41, a force directed from the developing roller 41 to the photosensitive drum 1 is exerted on urethane particles. Accordingly, a supply operation for supplying urethane particles from the developing roller 41 to the photosensitive drum 1 is performed. The urethane particles having transferred onto the photosensitive drum 1 are fed to the entire longitudinal region of the cleaning blade 51 according to the rotation of the photosensitive drum 1, and, therefore, function as lubricant to reduce the friction between the photosensitive drum 1 and the cleaning blade 51.

On the other hand, toner is sequentially fed from the toner storage portion 43 in the developing unit 4 to the developing roller 41 while urethane particles as an initial coating agent are expelled from the developing roller 41. The fed toner functions as lubricant on the developing roller 41 instead of urethane particles. However, in a case where the toner is slowly fed to the developing roller 41, as urethane particles are expelled, lubricant may run out on the developing roller 41, thus resulting in an increase in torque to cause step-out of a developing gear (not illustrated).

To solve this issue, according to the fifth exemplary embodiment, after expelling urethane particles for a predetermined time, the image forming apparatus 100 causes the laser scanner (exposure device) 11 to start an exposure operation (supply operation) for retaining an initial coating agent on the developing roller 41 (in a period "α" in FIG. 23). The exposure operation causes the surface potential of the photosensitive drum 1 to become −200 V. Accordingly, starting with a point of time when the exposed portion of the photosensitive drum 1 has reached the developing contact portion, urethane particles having positive polarity remain on the developing roller 41 owing to the potential relationship between the surface potential (−350 V) of the developing roller 41 and the surface potential (−200 V) of the photosensitive drum 1 (in a period C in FIG. 23). More specifically, exposing the charging applied portion of the photosensitive drum 1 changes the potential of the photosensitive drum 1 from −500 V to −200 V, which is close to the potential of the urethane particles. Between the region of the photosensitive drum 1 exposed after being charged and the developing roller 41, there is formed an electric field that retains urethane particles on the developing roller 41. Thus, there is formed an electric field that exerts, on urethane particles, a force directed from the photosensitive drum 1 to the developing roller 41. The developing roller 41 is sequentially supplied with toner from the toner storage portion 43 while retaining urethane particles thereon, so that the developing roller 41 constantly retains lubricant to prevent an increase in torque of the developing roller 41.

After the exposure operation is performed for a predetermined time (a period "α" in FIG. 23), starting with a point of time when the exposure end portion has reached the developing contact portion, urethane particles transfer to the photosensitive drum 1 again owing to the potential relationship between the surface potential (−350 V) of the developing roller 41 and the surface potential (−500 V) of the photosensitive drum 1 (in a period D in FIG. 23). The urethane particles having transferred onto the photosensitive drum 1 are fed to the entire longitudinal region of the cleaning blade 51 according to the rotation of the photosensitive drum 1, and, therefore, function as lubricant again to reduce the friction between the photosensitive drum 1 and the cleaning blade 51.

On the other hand, the surface of the developing roller 41 after expelling all of the urethane particles is coated with toner having negative polarity. The toner remains on the developing roller 41 owing to the potential relationship between the surface potential (−350 V) of the developing roller 41 and the surface potential (−500 V) of the photosensitive drum 1 (in a period E in FIG. 23).

Furthermore, after the completion of the exposure operation, the image forming apparatus 100 causes the separation mechanism 60 thereof to operate to actually separate the developing roller 41 from the photosensitive drum 1. More specifically, in the first operation (in a period "a" in FIG. 23), the moving member 62 of the separation mechanism 60 is moved to the second position. At this point of time, the position of the separation mechanism 60 of the image forming apparatus 100 coincides the actual contact state of the developing roller 41 for the first time. In the second operation (in a period "b" in FIG. 23), the moving member 62 of the separation mechanism 60 is moved again to the first position. As a result, the developing roller 41 becomes separated from the photosensitive drum 1 in all of the first to fourth process cartridges P (PY, PM, PC, and PK).

In this state, the image forming apparatus 100 performs a belt cleaning operation (in a period "θ" in FIG. 23) to cause a cleaning unit (not illustrated) for the intermediate transfer belt 13 to collect residual toner on the intermediate transfer belt 13, and then turns off the main motor 95 to terminate the initial operation.

As described above, according to the fifth exemplary embodiment, the surface of the developing roller 41 in a process cartridge P that is a new one is coated with urethane particles having positive polarity, which is opposite to toner in polarity, as an initial coating agent. Toner, serving as developer, is stored in the toner storage portion 43 mounted in the developing unit 4. With the configuration of the image forming apparatus 100 having such process cartridges P mounted therein, in a case where the controller 91 has detected the mounting of a new process cartridge P, the image forming apparatus 100 can determine that the developing roller 41 is surely in contact with the photosensitive drum 1 in all of the first to fourth process cartridges P (PY, PM, PC, and PK). Accordingly, in the initial operation, prior to causing the separation mechanism 60 of the image forming apparatus 100 to operate (in a state in which the separation mechanism 60 is in the first position), the image forming apparatus 100 can perform a supply operation for supplying an initial coating agent from the developing roller 41 to the contact portion between the photosensitive drum 1 and the cleaning blade 51.

However, if all of the initial coating agent is supplied to the photosensitive drum 1, there becomes no lubricant between the developing roller 41 and the developing blade 42. Therefore, the image forming apparatus 100 additionally performs, in the initial operation, an exposure operation for causing part of the initial coating agent to remain on the developing roller 41. The exposure operation can also be performed before the separation mechanism 60 is caused to operate, i.e., in a state in which the separation mechanism 60 is in the first position.

Thus, while two functions of inhibiting an increase in torque of the developing roller 41 in the initial operation and of preventing turning-up or chatter vibration of the cleaning blade 51 are satisfied, the initial operation time can be shortened by reducing a surplus operating time of the separation mechanism 60 and a cleaning time of the intermediate transfer belt 13 associated with the operation of the separation mechanism 60. Furthermore, the timing to start a next printing operation can be made earlier.

Moreover, the shortening of the initial operation time results in the reduction of the rotation time of the main motor 95, so that the rotation time of the photosensitive drum 1 or the intermediate transfer belt 13 can be reduced to attain the long lifetime of the image forming apparatus 100.

While, in the fifth exemplary embodiment, the separation mechanism 60 is divided into a member for the first to third process cartridges P (PY, PM, and PC) and a member for the fourth process cartridge P (PK), this is not a restrictive one. The divided manner of the separation mechanism 60 can be arbitrarily set as appropriate.

Furthermore, while, in the fifth exemplary embodiment, urethane particles are used as an initial coating agent, this is not a restrictive one. Some other suitable materials can be used as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-181995 filed Sep. 3, 2013 and No. 2014-154993 filed Jul. 30, 2014, which are hereby incorporated by reference herein in their entirety.

What is claimed is:

1. An image forming apparatus comprising:

a process cartridge including a photosensitive member and a developing roller configured to develop a latent image formed on the photosensitive member;

a mounting portion to and from which the process cartridge is attachable and detachable;

a separation mechanism configured to take a first position to separate the developing roller from the photosensitive member and a second position to bring the developing roller into contact with the photosensitive member;

an allowance mechanism configured to allow the process cartridge with the developing roller kept in contact with the photosensitive member to be mounted on the mounting portion when the separation mechanism is in the first position;

an exposure device configured to expose the photosensitive member with light; and a control unit configured to determine whether the developing roller and the photosensitive member of the process cartridge are in contact with each other and to control operations of the separation mechanism and the exposure device based on a result of determination, wherein the control unit, when determining that the developing roller and the photosensitive member are in contact with each other when the separation mechanism is in the first position, performs an exposure operation to cause the exposure device to expose the photosensitive member with light while keeping the separation mechanism in the first position during an initial operation of the image forming apparatus.

2. The image forming apparatus according to claim 1, wherein the control unit performs, by performing the exposure operation, a supply operation to supply developer from the developing roller to a region of the photosensitive member exposed by the exposure device with light.

3. The image forming apparatus according to claim 2, wherein the process cartridge, which is attachable to the mounting portion, further includes a cleaning member configured to contact the photosensitive member to remove developer remaining on the photosensitive member, wherein the supply operation is an operation to feed developer as lubricant from the developing roller to the cleaning member via the photosensitive drum.

4. The image forming apparatus according to claim 2, wherein the supply operation is a calibration operation to supply developer from the developing roller to form, on the photosensitive member, a patch image used to adjust an output image.

5. The image forming apparatus according to claim 1, wherein a surface of the developing roller when in an unused state is coated with an initial coating agent, and wherein the control unit prevents, by performing the exposure operation, the initial coating agent from being supplied from the developing roller 41 to the photosensitive member.

6. The image forming apparatus according to claim 5, wherein the control unit performs the exposure operation and a charging operation for charging the photosensitive member while keeping the separation mechanism in the first position in the initial operation, wherein an electric field formed between a region of the photosensitive member charged by the charging operation and the developing roller exerts, on the initial coating agent, a force directed from the developing roller to the photosensitive member, and wherein an electric field formed between a region of the photosensitive member charged by the charging operation and then exposed with light by the exposure device and the developing roller exerts, on the initial coating agent, a force directed from the photosensitive member to the developing roller.

7. The image forming apparatus according to claim 6, wherein the process cartridge, which is attachable to the mounting portion, further includes a cleaning member configured to contact the photosensitive member to remove developer remaining on the photosensitive member, and wherein, in the initial operation, the initial coating agent supplied to the photosensitive member is fed as lubricant to the cleaning member.

8. The image forming apparatus according to claim 5, wherein the initial coating agent is charged with a polarity that is opposite to a normal polarity of developer.

9. The image forming apparatus according to claim 1, wherein the process cartridge further includes a charging member configured to charge the photosensitive member.

10. The image forming apparatus according to claim 1, further comprising a reading unit configured to read information stored in a memory included in the process cartridge, wherein the control unit detects, based on the information read by the reading unit, that a new process cartridge has been attached to the mounting portion or that the process cartridge has been replaced, and thus determines that the developing roller and the photosensitive member of the process cartridge are in contact with each other.

11. The image forming apparatus according to claim 1, further comprising an opening and closing member configured to be opened and closed during attachment and detachment of the process cartridge, an interlocking mechanism configured to separate or bring the photosensitive member of the process cartridge from or into contact with a transfer member facing the photosensitive member in conjunction with an operation for opening and closing the opening and closing member, and an opening and closing detection unit configured to detect opening and closing of the opening and closing member, wherein, when detecting opening of the opening and closing member based on a signal from the opening and closing detection unit, the control unit determines that the developing roller and the photosensitive member of the process cartridge are in contact with each other.

12. The image forming apparatus according to claim 1, further comprising a reading unit configured to read information stored in a memory included in the process cartridge, an opening and closing member configured to be opened and closed during attachment and detachment of the process cartridge, an interlocking mechanism configured to separate or bring the photosensitive member of the process cartridge from or into contact with a transfer member facing the photosensitive member in conjunction with an operation for opening and closing the opening and closing member, and an opening and closing detection unit configured to detect opening and closing of the opening and closing member, wherein, when detecting opening of the opening and closing member based on a signal from the opening and closing detection unit and detecting that the process cartridge has not been replaced based on information from the reading unit, the control unit performs an image forming operation without performing the initial operation.

13. The image forming apparatus according to claim 1, wherein the image forming apparatus is configured to allow a plurality of process cartridges to be detachably mounted therein and has a plurality of print modes capable of forming a full-color image or a mono-color image, and wherein the separation mechanism is divided into a plurality of separation mechanisms and is changeable among a standby state in which the developing roller and the photosensitive member is separated from each other in all of the plurality of process cartridges, a full-color image forming state in which the developing roller and the photosensitive member are in contact each other in all of the plurality of process cartridges, and a mono-color image forming state in which the developing roller and the photosensitive member are in contact each other only in a process cartridge for black among the plurality of process cartridges.

14. An image forming apparatus comprising:

a process cartridge including a photosensitive member, a developing roller configured to develop a latent image formed on the photosensitive member, and a cleaning member configured to contact the photosensitive member to remove developer remaining on the photosensitive member;

a mounting portion to and from which the process cartridge is attachable and detachable;

a separation mechanism configured to take a first position to separate the developing roller from the photosensitive member and a second position to bring the developing roller into contact with the photosensitive member;

an allowance mechanism configured to allow the process cartridge with the developing roller kept in contact with the photosensitive member to be mounted on the mounting portion when the separation mechanism is in the first position;

a cartridge detection unit configured to detect whether the process cartridge is a new one; and a control unit configured to control an initial operation, which the image forming apparatus performs prior to image formation, wherein, when a new process cartridge has been mounted on the mounting portion when the separation mechanism is in the first position, the control unit performs a supply operation to supply lubricant from the developing roller toward a contact portion between the photosensitive member and the cleaning member while keeping the separation mechanism in the first position.

15. The image forming apparatus according to claim 14, wherein the allowance mechanism is provided in the separation mechanism.

16. The image forming apparatus according to claim 15, wherein, when the process cartridge is mounted on the mounting portion with the photosensitive member and the developing roller kept in contact with each other, the allowance mechanism is caused to retract by contacting the process cartridge.

17. The image forming apparatus according to claim 14, wherein the allowance mechanism is provided in the process cartridge.

18. The image forming apparatus according to claim 17, wherein, when the process cartridge is mounted on the mounting portion with the photosensitive member and the developing roller kept in contact with each other, the allowance mechanism is caused to retract by contacting the separation mechanism.

19. The image forming apparatus according to claim 14, wherein the lubricant is developer.

20. The image forming apparatus according to claim 14, wherein the lubricant is an initial coating agent with which the developing roller in an unused process cartridge is coated.

21. An image forming apparatus comprising:

a process cartridge including a photosensitive member and a developing roller configured to develop a latent image formed on the photosensitive member;

a mounting portion to and from which the process cartridge is attachable and detachable;

a separation mechanism configured to take a first position to separate the developing roller from the photosensitive member and a second position to bring the developing roller into contact with the photosensitive member;

an allowance mechanism configured to allow the process cartridge with the developing roller kept in contact with the photosensitive member to be mounted on the mounting portion when the separation mechanism is in the first position;

an exposure device configured to expose the photosensitive member with light; and a control unit configured to control operations of the separation mechanism and the exposure device, wherein, in a case where the process cartridge with the developing roller kept in contact with the photosensitive member is attached to the mounting portion when the separation mechanism is in the first position, the control unit is configured to cause the exposure device to start an exposure operation to expose the photosensitive member with light, without moving the separation mechanism from the first position to the second position.

22. The image forming apparatus according to claim 21, wherein the control unit performs, by performing the exposure operation of the exposure device, a supply operation to supply developer from the developing roller to a region of the photosensitive member exposed with light by the exposure device.

23. The image forming apparatus according to claim 22, wherein the process cartridge further includes a cleaning member configured to contact the photosensitive member to remove developer remaining on the photosensitive member, and wherein the developer supplied to the photosensitive member through the supply operation is supplied to a contact portion between the cleaning member and the photosensitive member from the developing member via the photosensitive member.

24. The image forming apparatus according to claim 22, wherein the supply operation is a calibration operation to supply developer from the developing roller to form, on the photosensitive member, a patch image used to adjust an output image.

25. The image forming apparatus according to claim 21, wherein a surface of the developing roller when in an unused state is coated with an initial coating agent, and wherein the control unit prevents, by performing the exposure operation, the initial coating agent from being supplied from the developing roller 41 to the photosensitive member.

26. The image forming apparatus according to claim 25, wherein, after the process cartridge with the developing roller kept in contact with the photosensitive member is attached to the mounting portion when the separation mechanism is in the first position, the control unit starts the exposure operation and a charging operation for charging the photosensitive member, without moving the separation mechanism from the first position to the second position, wherein an electric field formed between a region of the photosensitive member charged by the charging operation and the developing roller exerts, on the initial coating agent, a force directed from the developing roller to the photosensitive member, and wherein an electric field formed between a region of the photosensitive member charged by the charging operation and then exposed with light by the exposure device and the developing roller exerts, on the initial coating agent, a force directed from the photosensitive member to the developing roller.

27. The image forming apparatus according to claim 26, wherein the process cartridge, which is attachable to the mounting portion, further includes a cleaning member configured to contact the photosensitive member to remove developer remaining on the photosensitive member, and wherein, in the initial operation, the initial coating agent supplied to the photosensitive member is fed as lubricant to the cleaning member.

28. The image forming apparatus according to claim 25, wherein the initial coating agent is charged with a polarity that is opposite to a normal polarity of developer.

29. The image forming apparatus according to claim 21, wherein the process cartridge further includes a charging member configured to charge the photosensitive member.

30. The image forming apparatus according to claim 21, further comprising a reading unit configured to read information stored in a memory included in the process cartridge, wherein, in a case where the process cartridge is attached to the mounting portion when the separation mechanism is in the first position, the developing roller and the photosensitive member included in the process cartridge that has been attached to the mounting portion when the separation mechanism is in the first position are in contact with each other, and wherein in a case where the control unit detects, based on the information read by the reading unit, that a new process cartridge has been attached to the mounting portion or that the process cartridge has been replaced, the control unit causes, based on a result of the detection, the exposure device to start the exposure operation to expose the photosensitive member with light without moving the separation mechanism from the first position to the second position.

31. The image forming apparatus according to claim 21, further comprising an opening and closing member configured to be opened and closed during attachment and detachment of the process cartridge, an interlocking mechanism configured to separate or bring the photosensitive member of the process cartridge from or into contact with a transfer member facing the photosensitive member in conjunction with an operation for opening and closing the opening and closing member, and an opening and closing detection unit configured to detect opening and closing of the opening and closing member, wherein, in a case where the opening and closing member is closed after the opening and closing member is opened when the separation mechanism is in the first position, the developing roller and the photosensitive member included in the process cartridge that has been attached to the mounting portion when the separation mechanism is in the first position are in contact with each other, and wherein the control unit detects opening of the opening and closing member based on a signal from the opening and closing detection unit, and based on the detection, the control unit causes the exposure device to start the exposure operation to expose the photosensitive member with light without moving the separation mechanism to be moved from the first position to the second position.

32. The image forming apparatus according to claim 21, wherein the exposure operation performed by the exposure device is an exposure operation based on a received print signal.

33. The image forming apparatus according to claim 21, further comprising a reading unit configured to read information stored in a memory included in the process cartridge, an opening and closing member configured to be opened and closed during attachment and detachment of the process cartridge, an interlocking mechanism configured to separate or bring the photosensitive member of the process cartridge from or into contact with a transfer member facing the photosensitive member in conjunction with an operation for opening and closing the opening and closing member, and an opening and closing detection unit configured to detect opening and closing of the opening and closing member, wherein, in a case where the opening and closing member is closed after the opening and closing member is opened when the separation mechanism is in the first position, the developing roller and the photosensitive member included in the process cartridge that has been attached to the mounting portion when the separation mechanism is in the first position are in contact with each other, and wherein, the control unit detects opening of the opening and closing member based on a signal from the opening and closing detection unit and detects, based on information from the reading unit, that the process cartridge has not been replaced, the control unit causes the exposure device to start the exposure operation without moving the separation mechanism from the first position to the second position.

34. The image forming apparatus according to claim 21, wherein the image forming apparatus is configured to allow a plurality of the process cartridges to be attached thereto and be able to perform in a full-color image forming mode forming a full-color image and in a mono-color image forming mode forming a mono-color image, wherein, the separation mechanism is able to shift to a standby state, a first image forming state, and a second image forming state, and wherein, the developing roller is separated from the photosensitive member in each of all the plurality of process cartridges in the standby state, the developing roller contacts the photosensitive member in each of all the plurality of process cartridges in the first image forming state, and the developing roller contacts the photosensitive member only in at least one process cartridge among the plurality of process cartridges while the developing roller is separated from the photosensitive member in the other process cartridge in the second image forming state.

35. The image forming apparatus according to claim 21, wherein the separation mechanism includes an engagement member configured to separate the developing roller from the photosensitive member by engaging with a force receiving portion of the process cartridge to exert a force on the force receiving portion, and, in a case where the process cartridge is attached to the mounting portion when the separation mechanism is in the first position, the engagement member retracts by contacting the process cartridge.

36. The image forming apparatus according to claim 35, wherein in a case where the separation mechanism is moved to the second position from a state that the separation mechanism is in the first position and the engagement member has retracted, the engagement member engages with the force receiving portion, and in a case where the separation mechanism is further moved to the first position, the engagement member exerts a force on the force receiving portion to separate the developing roller from the photosensitive member.

37. The image forming apparatus according to claim 21, wherein the process cartridge includes an urging member including a first unit configured to support the photosensitive drum and a second unit configured to support the developing roller and be movable with respect to the first unit, the urging member configured to urge the second unit in a direction that the developing roller contacts the photosensitive drum.

38. An image forming apparatus comprising:

a process cartridge including a photosensitive member, a developing roller configured to develop a latent image formed on the photosensitive member, and a cleaning member configured to contact the photosensitive member to remove developer remaining on the photosensitive member;

a mounting portion to and from which the process cartridge is attachable and detachable;

a separation mechanism configured to take a first position to separate the developing roller from the photosensitive member and a second position to bring the developing roller into contact with the photosensitive member;

an allowance mechanism configured to allow the process cartridge with the developing roller kept in contact with the photosensitive member to be mounted on the mounting portion when the separation mechanism is in the first position;

a cartridge detection unit configured to detect whether the process cartridge is a new one; and a control unit configured to control an operation of the separation mechanism, wherein, in a case where the process cartridge with the developing roller kept in contact with the photosensitive member is attached to the mounting portion when the separation mechanism is in the first position, and the process cartridge attached to the mounting portion is new, the control unit starts a supply operation to supply lubricant from the developing roller to a contact portion between the photosensitive member and the cleaning member without moving the separation mechanism from the first position to the second position.

39. The image forming apparatus according to claim 38, wherein the allowance mechanism is provided in the separation mechanism.

40. The image forming apparatus according to claim 38, wherein the separation mechanism includes an engagement member configured to separate the developing roller from the photosensitive member by engaging with a force receiving portion of the process cartridge to exert a force on the force receiving portion, and, in a case where the process cartridge is attached to the mounting portion when the separation mechanism is in the first position, the engagement member retracts by contacting the process cartridge.

41. The image forming apparatus according to claim 40, wherein in a case where the separation mechanism is moved to the second position from a state that the separation mechanism is in the first position and the engagement member has retracted, the engagement member engages with the force receiving portion, and in a case where the separation mechanism is further moved to the first position, the engagement member exerts a force on the force receiving portion to separate the developing roller from the photosensitive member..

42. The image forming apparatus according to claim 38, wherein the process cartridge includes an urging member including a first unit configured to support the photosensitive drum and a second unit configured to support the developing roller and be movable with respect to the first unit, the urging member configured to urge the second unit in a direction that the developing roller contacts the photosensitive drum.

43. The image forming apparatus according to claim 38, wherein the allowance mechanism is provided in the process cartridge.

44. The image forming apparatus according to claim 43, wherein, when the process cartridge is mounted on the mounting portion with the photosensitive member and the developing roller kept in contact with each other, the allowance mechanism is caused to retract by contacting the separation mechanism.

45. The image forming apparatus according to claim 38, wherein the lubricant is developer.

46. The image forming apparatus according to claim 38, wherein the lubricant is an initial coating agent with which the developing roller in an unused process cartridge is coated.

* * * * *